US011192619B2

(12) United States Patent
Yao et al.

(10) Patent No.: US 11,192,619 B2
(45) Date of Patent: Dec. 7, 2021

(54) ROBOTIC FISH

(71) Applicant: National Taipei University of Technology, Taipei (TW)

(72) Inventors: Leeh-Ter Yao, Taipei (TW); Huei-Jyuan Lin, Taipei (TW); Li-Yuan Yeh, Taipei (TW); Yu-Chieh Tsai, Taipei (TW); Yu-Siao Jheng, Taipei (TW)

(73) Assignee: NATIONAL TAIPEI UNIVERSITY OF TECHNOLOGY, Taipei (TW)

( * ) Notice: Subject to any disclaimer, the term of this patent is extended or adjusted under 35 U.S.C. 154(b) by 0 days.

(21) Appl. No.: 17/029,547

(22) Filed: Sep. 23, 2020

(65) Prior Publication Data

US 2021/0276678 A1 Sep. 9, 2021

(30) Foreign Application Priority Data

Mar. 5, 2020 (TW) ..... 109107313

(51) Int. Cl.

| | |
|---|---|
| ***B63H 1/36*** | (2006.01) |
| ***B63G 8/08*** | (2006.01) |
| ***B63G 8/00*** | (2006.01) |

(52) U.S. Cl.

CPC ..... *B63H 1/36* (2013.01); *B63G 8/001* (2013.01); *B63G 8/08* (2013.01); *B63G 2008/004* (2013.01)

(58) Field of Classification Search

CPC ... B63H 1/30; B63H 1/32; B63H 1/36; B63G 8/001; B63G 2008/002; B63G 2008/004; B63G 2008/005; B63G 8/08; B63G 8/14; B63G 8/26; A63H 23/00; A63H 23/04; A63H 23/10; A63H 23/14

See application file for complete search history.

(56) References Cited

U.S. PATENT DOCUMENTS

| | | | | |
|---|---|---|---|---|
| 4,832,650 | A * | 5/1989 | Tong | A63H 23/10 43/26.2 |
| 9,090,320 | B2 * | 7/2015 | Rufo | B63H 11/00 |
| 9,701,380 | B2 * | 7/2017 | Lu | A63H 23/08 |
| 9,937,986 | B1 | 4/2018 | Oh et al. | |
| 11,110,364 | B2 * | 9/2021 | Jonas | A63H 29/22 |

FOREIGN PATENT DOCUMENTS

| | | | | |
|---|---|---|---|---|
| CN | 106005336 | A | 10/2016 | |
| CN | 206867707 | U | 1/2018 | |
| CN | 108438182 | A | 8/2018 | |
| EP | 3308910 | A4 * | 3/2019 | A63H 29/22 |
| KR | 10-2018677 | | 9/2019 | |
| TW | M390808 | U1 | 10/2010 | |

* cited by examiner

*Primary Examiner* — Ajay Vasudeva

(74) *Attorney, Agent, or Firm* — Birch, Stewart, Kolasch & Birch, LLP

(57) ABSTRACT

A robotic fish includes a front body, a rear body that includes a first segment and a second segment, and a driving unit. The first segment has a front engaging portion projecting toward and pivotally connected to the front body, and a rear engaging portion formed with a recess that recedes toward the front body and pivotally connected to the second segment. The driving unit includes a motor disposed in the front engaging portion, and a shaft extending along a dorsoventral axis and connecting the motor and the rear connecting portion. A ratio of a distance between the shaft and a foremost edge of the front engaging portion to a distance between the foremost edge and an extreme point of the recess ranges from 0.075 to 0.75.

14 Claims, 15 Drawing Sheets

ROBOTIC FISH

CROSS-REFERENCE TO RELATED APPLICATION

This application claims priority to Taiwanese Invention Patent Application No. 109107313, filed on Mar. 5, 2020.

FIELD

The disclosure relates to a bionic robot, and more particularly to a robotic fish.

BACKGROUND

Nowadays, robotic fish is considered to be one of the most important tools used in underwater environment because of the fish-type swimming mechanism of the robotic fish. The fish-type swimming mechanism allows the robotic fish to move efficiently underwater, and is able to overcome limitations of a traditional underwater propulsion mechanism using a propeller. In addition, the robotic fish can not only be used to explore resources in the sea, but also to serve as an aquarium fish.

SUMMARY

Therefore, an object of the disclosure is to provide a robotic fish.

According to the disclosure, the robotic fish includes a front body, a rear body, a caudal fin, a first driving unit, a second driving unit, a third driving unit, a center-of-gravity (CG) adjusting unit and a controller.

The front body has a rear connecting portion.

The rear body is disposed behind the front body in a swimming direction, in which the robotic fish swims. The rear body includes a first segment having a front engaging portion and a rear engaging portion, and a second segment having a front connecting portion and a rear end.

The front engaging portion of the first segment projects toward the front body in the swimming direction, is connected to the rear connecting portion, overlaps the rear connecting portion along a dorsoventral axis of the robotic fish, and has a foremost edge in the swimming direction. The rear engaging portion of the first segment is opposite to the front engaging portion in the swimming direction, and is formed with a recess that recedes toward the toward the front body in the swimming direction and that has a deepest point closest to the front engaging portion in the swimming direction.

The front connecting portion of the second segment is connected to the rear engaging portion, and overlaps the rear engaging portion along the dorsoventral axis. The rear end of the second segment is opposite to the front connecting portion in the swimming direction.

The caudal fin is connected to the rear end of the second segment.

The first driving unit is configured to drive the front body to swing left and right relative to the first segment, and includes a motor and a shaft. The motor is disposed in the front engaging portion. The shaft has a central axis extending along the dorsoventral axis, a first end connected to the motor, and a second end fixedly connected to the rear connecting portion.

The CG adjusting unit is disposed in the front body, and includes a weight that is movable in one of the swimming direction and a posterior direction opposite to the swimming direction to adjust a center of gravity of the robotic fish.

The second driving unit is disposed in the front body, is connected to the CG adjusting unit, and is configured to drive the weight to move in one of the swimming direction and the posterior direction.

The third driving unit is disposed in the front connecting portion of the second segment, and is configured to drive the first segment to swing left and right relative to the second segment.

The controller is disposed in one of the front body and the rear body, is electrically connected to the first, second and third driving unit, and is configured to control operation of the first, second and third driving unit.

A ratio of a first distance between the central axis of the shaft and the foremost edge of the front engaging portion to a second distance between the foremost edge of the front engaging portion and the deepest point of the recess of the rear engaging portion ranges from 0.075 to 0.75.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
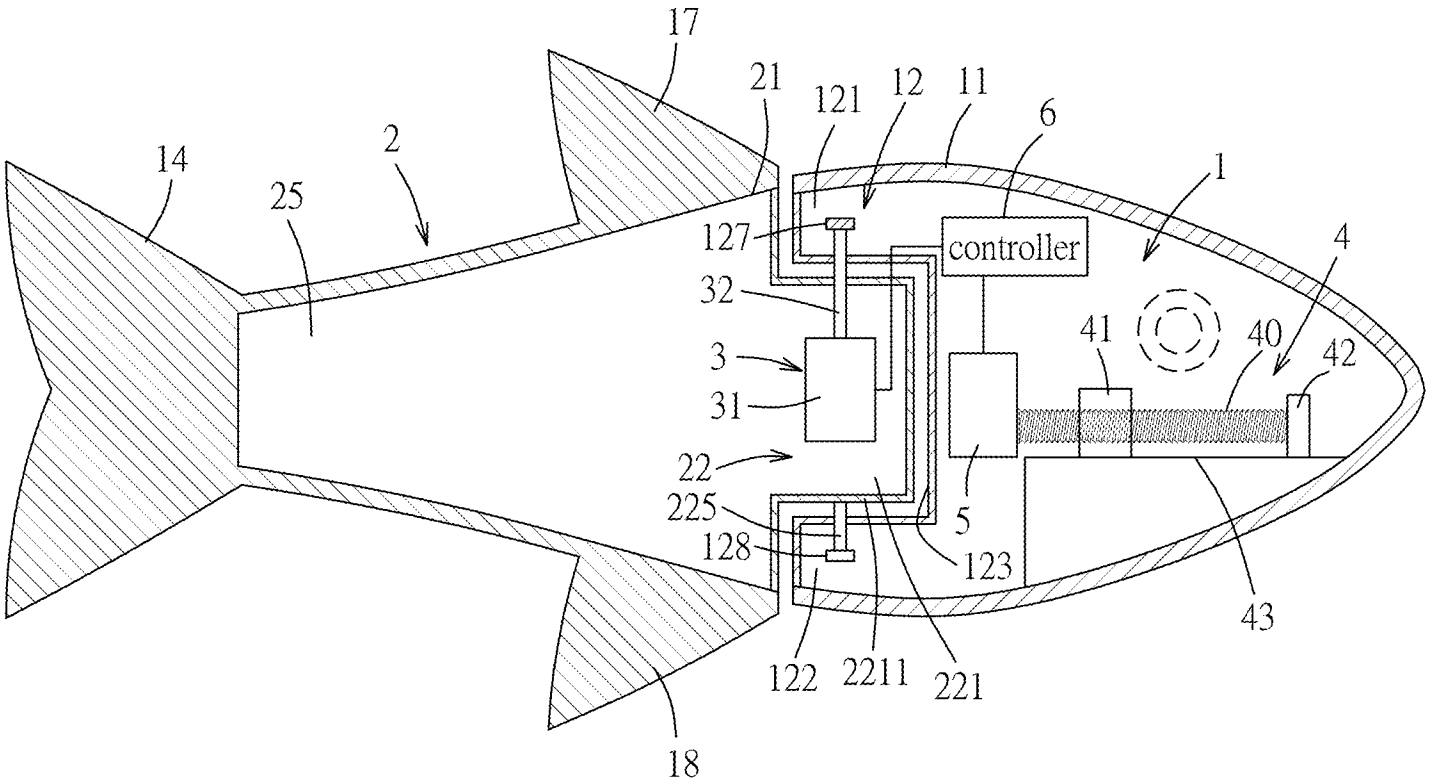
FIG. 1 is a schematic diagram illustrating an embodiment of the robotic fish according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, an embodiment of a robotic fish includes a front body 1, a rear body 2 pivotally connected to the front body 1, a first driving unit 3, a center-of-gravity (CG) adjusting unit 4, a second driving unit 5 and a controller 6. In this embodiment, each of the front body 1 and the rear body 2 is a single component that is sealed to be watertight. The front body 1 has a rear end 11 facing the rear body 2, and a rear connecting portion 12 disposed at the rear end 11. The rear connecting portion 12 of the front body 1 is formed with a recess 123 receding in a swimming direction, in which the robotic fish swims, and has a first projecting block 121 and a second projecting block 122. The second projecting block 122 is opposite to and spaced apart from the first projecting block 121 along a dorsoventral axis of the robotic fish to define the recess 123 of the rear connecting portion 12 therebetween.

The rear body 2 is disposed behind the front body 1 in the swimming direction, and has a front end 21 facing the front body 1, a front engaging portion 22 disposed at the front end 21, and a rear end 25 opposite to the front end 21. The front engaging portion 22 projects toward the front body 1 in the swimming direction, and is pivotally connected to the rear connecting portion 12. The front engaging portion 22 includes a forward projecting block 221 that projects from the front end 21 toward the front body 1 and that extends into the recess 123 of the rear connecting portion 12, so that the front engaging portion 22 overlaps the rear connecting portion 12 along the dorsoventral axis of the robotic fish. That is to say, the first projecting block 121 and the second projecting block 122 of the rear connecting portion 12 overlap the forward projecting block 221 of the front engaging portion 22 along the dorsoventral axis. It should be noted that it may not be necessary for the rear connecting portion 12 and the front engaging portion 22 to be one having a recess and the other having a projecting block; instead, in other embodiments, each of the rear connecting portion 12 and the front engaging portion 22 may have an L-shaped projecting block, and the L-shaped projecting blocks respectively of the rear connecting portion 12 and the front engaging portion face and are connected to each other to form a structural configuration in a shape of ⊔.

In the present embodiment, the front body 1 is an anterior segment (e.g., a fish head portion) of the robotic fish, and the rear body 2 is a posterior segment (e.g., a fish body portion) of the robotic fish.

Figure 2:
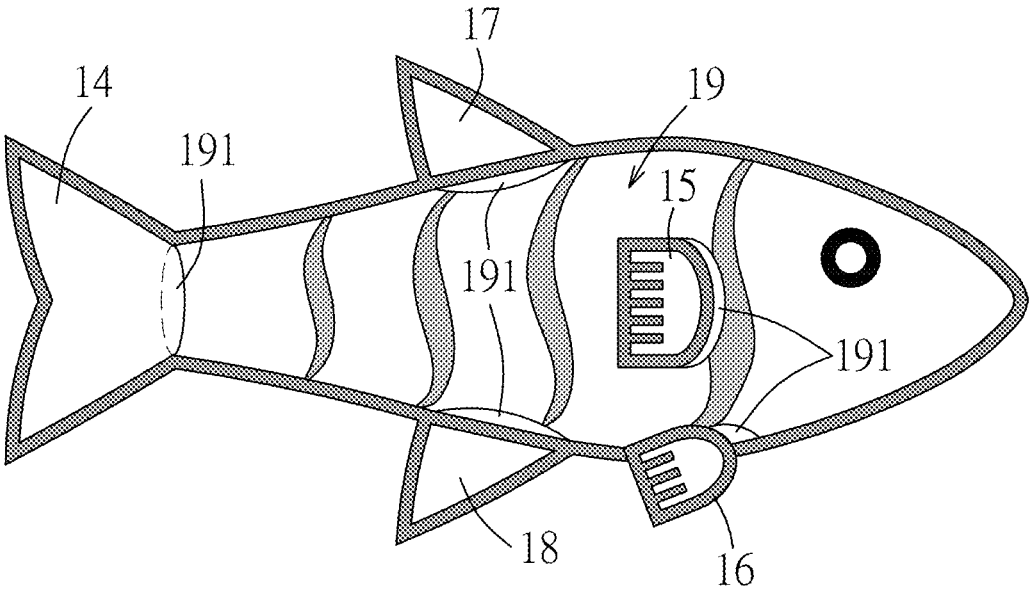
FIG. 2 is a schematic diagram illustrating a skin that covers a front body and a rear body according to an embodiment of this disclosure.

Further referring to FIG. 2, the robotic fish further includes a caudal fin 14 connected to the rear body 2, a pair of pectoral fins 15 (only one pectoral fin of the pair is visible) and a pair of pelvic fins 16 (only one pelvic fin of the pair is shown in FIG. 2, and the same is omitted from FIG. 1) connected to the front body 1, a dorsal fin 17 and an anal fin 18 connected to the rear body 2, and a skin 19 covering the front body 1 and the rear body 2. The caudal fin 14, the pectoral fins 15, the pelvic fins 16, the dorsal fin 17 and the anal fin 18 are made of a flexible material (e.g., silica gel), and each may be adhered to or embedded in the front body 1 or the rear body 2. In some embodiments, each of the caudal fin 14, the pectoral fins 15, the pelvic fins 16, the dorsal fin 17 and the anal fin 18 may be provided with a magnetic component, and the front body 1 and/or the rear body 2 is/are also provided with magnetic components at corresponding positions where the fins 14-18 are disposed, so that the fins 14-18 can be attached to the front body 1 and/or the rear body 2 respectively at the corresponding positions by virtue of magnetic attraction. The caudal fin 14 is connected to the rear end 25 of rear body 2, and can make the robotic fish swim forward when the rear body 2 swings from side to side relative to the front body 1. The dorsal fin 17 is connected to a top side of the rear body 2 at a position close to the front body 1, the anal fin 18 is connected to a bottom side of the rear body 2 at a position close to the front body 1, the pectoral fins 15 are bilaterally symmetric and connected respectively to lateral sides of the front body 1 (i.e., left and right sides), and the pelvic fins 16 are bilaterally symmetric and are both connected to a bottom of the front body 1. The dorsal fin 17, the anal fin 18, the pectoral fins 15 and the pelvic fins 16 are useful in balancing the robotic fish when the robotic fish is swimming. In addition, the dorsal fin 17 and the anal fin 18 may both be disposed at the front body 1 or may be disposed at different ones of the front body 1 and the rear body 2 in other embodiments. In some embodiments, the robotic fish may include a plurality of the dorsal fins 17 or the anal fins 18. The caudal fin 14, the pectoral fins 15, the pelvic fins 16, the dorsal fin 17 and the anal fin 18 are made as replaceable components.

The skin 19 has a decorative pattern and is made of an elastic material (e.g., an elastic fabric printed with the decorative pattern). The skin 19 is formed with a plurality of openings 191 that correspond respectively to the caudal fin 14, the pectoral fins 15, the pelvic fins 16, the dorsal fin 17 and the anal fin 18 to allow the fins 14-18 to extend out of the skin 19 through the openings 191. The skin 19 completely covers the front body 1 and the rear body 2 of the robotic fish without covering the fins 14-18, and is also replaceable. In the case that the fins 14-18 are connected magnetically to the front body 1 and the rear body 2, formation of the openings 191 in the skin 19 may be skipped.

The first driving unit 3 is disposed in the front engaging portion 22, is connected to the controller 6, and is configured to output kinetic energy to the rear connecting portion 12 at the overlapping portion between the front engaging portion 22 and the rear connecting portion 12 (i.e., the overlapping portion between the first projecting block 121 and the forward projecting block 221) to drive the front body 1 to swing left and right relative to the rear body 2. In this embodiment, the first driving unit 3 includes a motor 31 and a shaft 32. The motor 31 is, for example, a servo motor, is sealed to be watertight and is fixedly disposed in the forward projecting block 221 of the front engaging portion 22, and includes a rotor (not shown). The shaft 32 has a central axis extending along the dorsoventral axis, a first end coaxially connected to the rotor of the motor 31, and a second end opposite to the first end and fixedly connected to the rear connecting portion 12.

Specifically, in this embodiment, the rear connecting portion 12 further has a fixed component 127 (e.g., a block) fixedly disposed in the first projecting block 121, and a first bearing 128 embedded in the second projecting block 122. The shaft 32 extends out of the forward projecting block 221 toward the first projecting block 121 and into the first projecting block 121, and the second end of the shaft 32 is fixedly connected to the fixed component 127 in the first projecting block 121. In addition, the forward projecting block 221 has a bottom side 2211 facing the second projecting block 122, and the front engaging portion 22 further includes a supporting rod 225 that extends from the bottom side 2211 of the forward projecting block 221 along the dorsoventral axis and that extends into and is connected rotatably to the second projecting block 122. In this embodiment, one end of the supporting rod 225 that is disposed in the second projecting block 122 is connected to the first bearing 128. Therefore, the supporting rod 225 can support the rear body 2 to make the rear body 2 swing steadily from side to side relative to the front body 1. As a result, when the kinetic energy generated by the motor 31 is outputted to the front body 1 through the shaft 32, the front body 1 can swing steadily from side to side relative to the rear body 2. It is noteworthy that it may also be that, in other embodiments, the shaft 32 is fixedly connected to the second projecting block 122 of the rear connecting portion 12, while the supporting rod 225 extends from a top side of the forward projecting block 221 (that is opposite to the bottom side 2211 along the dorsoventral axis) into the first projecting block 121 and is connected to a bearing disposed in the first projecting block 121.

Figure 3:
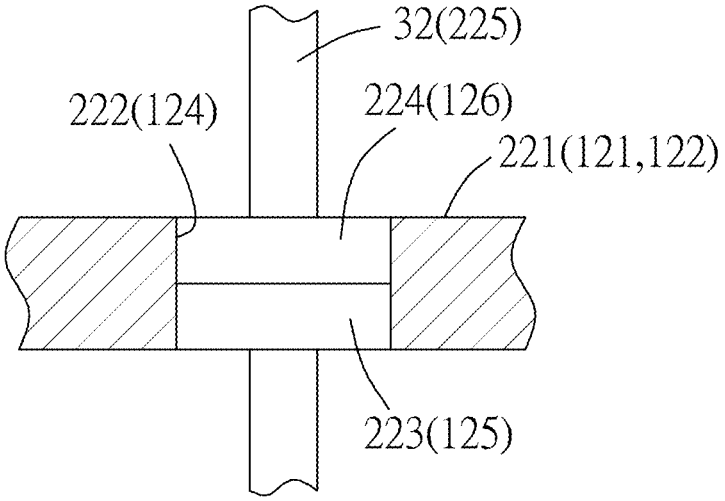
FIG. 3 is a cross-sectional view illustrating an implementation of watertight connection in the robotic fish according to an embodiment of the disclosure.

Referring to FIG. 3, the forward projecting block 221 of the front engaging portion 22 is formed with a circular through hole 222, and the front engaging portion 22 further includes an embedded bearing 223 and an oil seal 224 that are fittingly disposed in the circular through hole 222. The shaft 32 extends through the embedded bearing 223 and the oil seal 224 so as to transmit the kinetic energy generated by the motor 31 out of the forward projecting block 221. Similarly, each of the first projecting block 121 and the second projecting block 122 is formed with a circular through hole 124, and the rear connecting portion 12 further includes, for each of the first projecting block 121 and the second projecting block 122, a second bearing 125 and an oil seal 126 that are fittingly disposed in the circular through hole 124. The shaft 32 extends out of the forward engaging portion 221 into the first projecting block 121 through the second bearing 125 and the oil seal 126 that are disposed in the circular through hole 124 of the first projecting block 121, so as to transmit the kinetic energy generated by the motor 31 to the front body 1. Accordingly, rotation of the shaft 32 is steadied by the embedded bearing 223 of the front engaging portion 22 and the second bearing 125 disposed in the circular through hole 124 of the first projecting block 121, and the oil seal 224 of the front engaging portion 22 and the oil seal 126 disposed in the circular through hole 124 of the first projecting block 121 prevent water from penetrating into the interior of the front body 1 and the rear body 2 through the circular through holes 222, 124. Similarly, the supporting rod 225 extends through the second bearing 125 and the oil seal 126 that are disposed in the circular through hole 124 of the second projecting block 122 and achieves the watertight effect. Alternatively, in other embodiments, the first bearing 128, to which the supporting rod 225 is connected, may be fixed directly on a top outer surface of the second projecting block 122 that faces the bottom side 2211 of the forward projecting block 221, and thus the circular through hole 124 of the second projecting block 122 and the second bearing 125 and the oil seal 126 disposed therein can be omitted.

Figure 4:
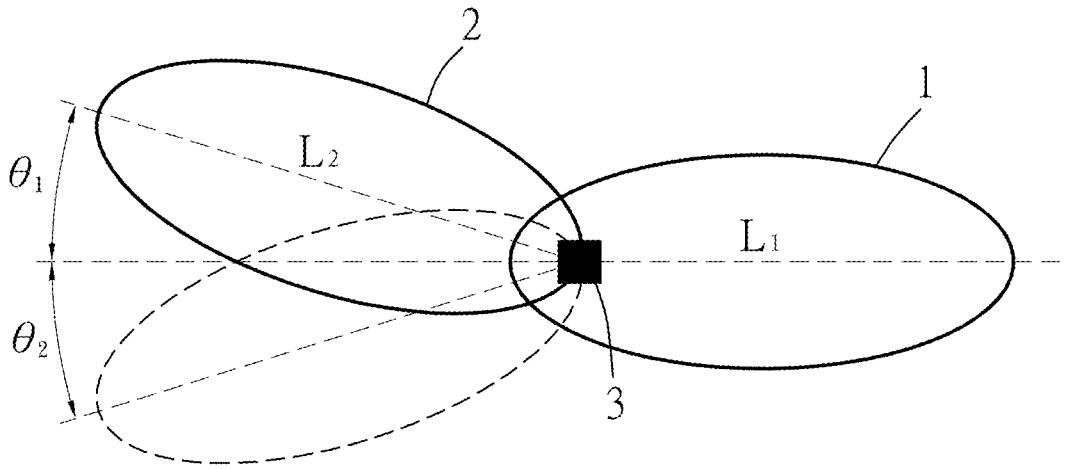
FIG. 4 is a schematic diagram illustrating the rear body swinging relative to the front body.

Referring to FIGS. 1 and 4, when the motor 31 is controlled by the controller 6 to drive the shaft 32 to continuously rotate back and forth, the shaft 32 then drives the front body 1 to swing left and right relative to the rear body 2 by a left swing angle ($\theta_1$) and a right swing angle ($\theta_2$). Specifically, a first imaginary central line ($L_1$) of the front body 1 that extends in a longitudinal direction of the front body 1 and a second imaginary central line ($L_2$) of the rear body 2 that extends in a longitudinal direction of the rear body 2 form the left swing angle ($\theta_1$) when the rear body 2 swings to the left relative to the front body 1, and form the right swing angle ($\theta_2$) when the rear body 2 swings to the right relative to the front body 1. Thus, when the robotic fish is placed in the water, the front body 1 and the rear body 2 swing relative to each other, thus making the caudal fin 14 swing. In such a way, the caudal fin 14 generates a forward propelling force to make the robotic fish swim forward. The controller 6 is configured to control the motor 31 so as to control rotation of the shaft 32 and then to control the left swing angle ($\theta_1$) and the right swing angle ($\theta_2$), making the robotic fish turn left or right. For example, the robotic fish may turn left when the left swing angle ($\theta_1$) is greater than zero and the right swing angle ($\theta_2$) is zero.

Referring to FIG. 1, the CG adjusting unit 4 is disposed in the front body 1 and near the bottom of the front body 1, and is configured to make the robotic fish ascend or dive. The CG adjusting unit 4 includes a weight 41 that is movable in the swimming direction (i.e., away from the rear body 2) or a posterior direction (i.e., toward the rear body 2) opposite to the swimming direction for adjusting a center of gravity of the robotic fish. A change in the center of gravity makes the robotic fish pitch and changes a pitch angle of the robotic fish, which, when coupled with the power generated by the relative swinging of the front body 1 and the rear body 2, makes the robotic fish ascend or dive.

In this embodiment, the CG adjusting unit 4 further includes a driving component 40, a third bearing 42 and a track 43. The third bearing 42 is immovably disposed in the front body 1 in front of the second driving unit 5, and the driving component 40 has a first end connected to the second driving unit 5 and a second end opposite to the first end and rotatably connected to the third bearing 42, and the weight 41 is connected to the driving component 40. The driving component 40 can be driven by the second driving unit 5 and then move the weight 41 in one of the swimming direction and the posterior direction.

For example, the driving component 40 is a screw 40 and the weight 41 is screwed on the screw 40. The bottom surface of the weight 41 is a flat surface. The track 43 is immovably disposed in the front body 1 and extends in an extension direction of the screw 40, and the track 43 has a top flat surface abutting against the bottom surface of the weight 41. Accordingly, when the screw 40 is driven by the second driving unit 5 to rotate in a first direction (e.g., a clockwise direction), the weight 41 will move along the screw 40 in the swimming direction away from the rear body 2 without rotation since the top flat surface of the track 43 restricts rotation of the weight 41. Similarly, when the screw 40 is driven by the second driving unit 5 to rotate in a second direction (e.g., a counterclockwise direction) opposite to the first direction, the weight 41 will move along the screw 40 in the posterior direction toward the rear body 2.

The second driving unit 5 is disposed in the front body 1, is connected with the CG adjusting unit 4 and the controller 6, and is configured to output kinetic energy to drive the weight 41 to move along the screw 40 in one of the swimming direction and the posterior direction. In this embodiment, the second driving unit is a motor having a rotor (not shown) coaxially connected to the first end of the screw 40 of the CG adjusting unit 4. Thus, when the second driving unit 5 is controlled by the controller 6 so that the rotor thereof rotates to drive the screw 40 to rotate in the first direction or the second direction, the screw 40 will drive the weight 41 to move along the screw 40 in the swimming direction or the posterior direction. It is noteworthy that configuration of the CG adjusting unit 4 is not limited to this embodiment. In other embodiments, the screw 40 may be replaced by a track (e.g., the track 43) or a similar component extending along a length of the first body 1, and the second driving unit 5 may be configured to directly drive the weight 41 to move along the track 43 in the swimming direction or the posterior direction.

Figure 5:
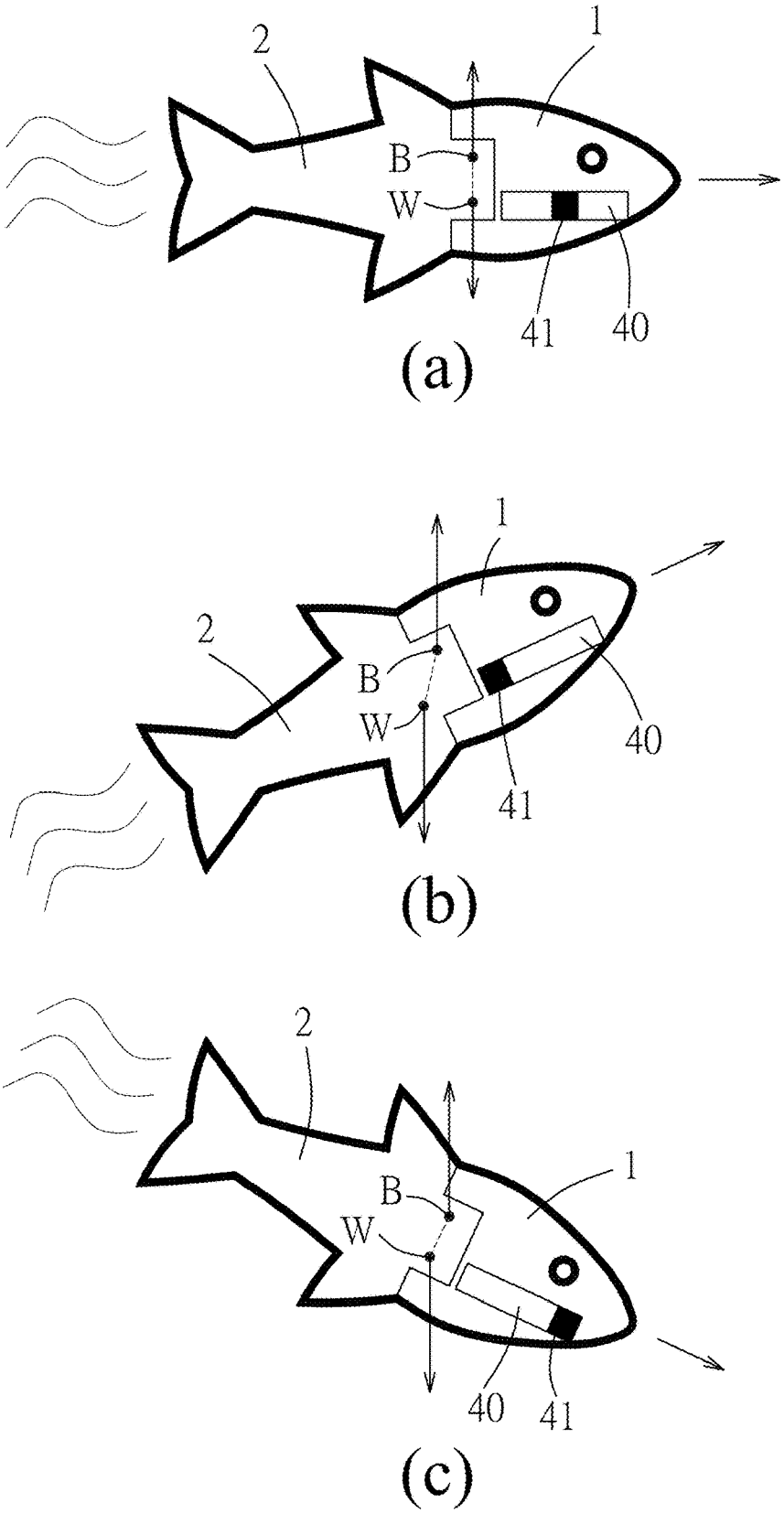
FIG. 5 is a schematic diagram illustrating adjustments of a center of gravity of the robotic fish to point the robotic fish up or down.

Referring to FIG. 5, when the robotic fish is placed in the water and the weight 41 is at the center of the screw 40, a center of buoyancy (B) of the robotic fish and the center of gravity (W) are aligned with each other along the dorsoventral axis. That is to say, the upward buoyant force and the downward gravitational force are exerted on the robotic fish along the same line (i.e., the dorsoventral axis), and therefore, the robotic fish can stay horizontal (see part (a) of FIG. 5). In this case, the power generated by relative swinging of the front body 1 and the rear body 2 from side to side will drive the robotic fish to travel forward. When the second driving unit 5 drives the screw 40 to move the weight 41 away from the center of the screw 40 in the posterior direction toward the rear body 2, the robotic fish will be tilted backward (i.e., pitching nose up) since the position of the center of gravity (W) is moved backward and the position of the center of buoyancy (B) remains unchanged (see part (b) of FIG. 5). Therefore, the power generated by relative swinging of the front body 1 and the rear body 2 from side to side will drive the robotic fish to ascend. When the second driving unit 5 drives the screw 40 to move the weight 41 away from the center of the screw 40 in the swimming direction away from the rear body 2, the robotic fish will be tilted forward (i.e., pitching nose down) since the center of gravity (W) is moved forward and the position of center of buoyancy (B) remains unchanged (see part (c) of FIG. 5), and therefore, the power generated by relative swinging of the front body 1 and the rear body 2 from side to side will drive the robotic fish to dive. In some embodiments, the weight 41 may be adjusted to make the density of the robotic fish equal to an environment where the robotic fish swims in (e.g., water), so that the robotic fish may remain at a certain level when the the weight 41 is at the center of the screw 40.

In this embodiment, the controller 6 is hermetically sealed and is disposed within the front body 1. In other embodiments, the controller 6 may be disposed within the rear body 2. The controller 6 is electrically connected to the first driving unit 3 and the second driving unit 5 through conducting wires (control cables), and is configured to control operations of the driving units 3, 5. In order to achieve watertight effect, the rear connecting portion 12 and the front engaging portion 22 may each be formed with an aperture (not shown) allowing the conducting wires to enter the front body 1 and the rear body 2 therethrough, where the apertures respectively of the rear connecting portion 12 and the front engaging portion 22 are hermetically sealed by using waterproof adhesive after the conducting wires have established the electrical connection of the controller 6 with the first driving unit 3 and the second driving unit 5.

Figure 6:
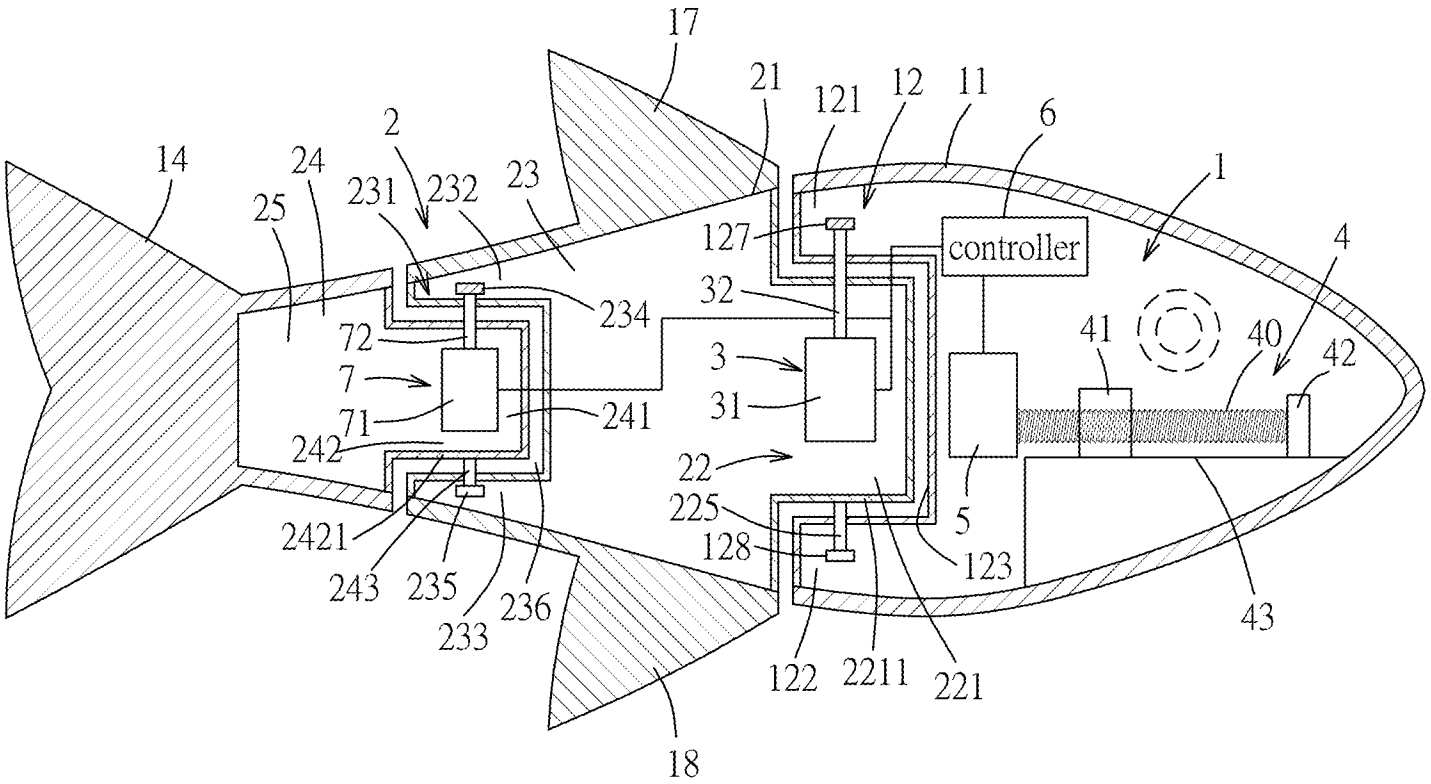
FIG. 6 is a schematic diagram illustrating another embodiment of the robotic fish according to the disclosure.

Referring to FIG. 6, according to another embodiment of this disclosure, the rear body 2 (i.e., the posterior segment of the robotic fish) is split into two parts; i.e., the rear body 2 includes a first segment 23, and a second segment 24 that is pivotally connected to the first segment 23 and that partially overlaps the first segment 23 in a direction parallel to the dorsoventral axis of the robotic fish. In this embodiment, the robotic fish further includes a third driving unit 7. The first segment 23 has the front end 21 of the rear body 2 at one end, the front engaging portion 22 at the front end 21, and a rear engaging portion 231 disposed at the other end of the first segment 23 that is opposite to the front end 21 and that is adjacent to the second segment 24. The second segment 24 has the rear end 25 of the rear body 2 at one end, and a front connecting portion 241 that is disposed at the other end of the second segment 24 opposite to the rear end 25 and adjacent to the first segment 23 and that partially overlaps the rear engaging portion 231 in the direction parallel to the dorsoventral axis. In the present embodiment, the rear engaging portion 231 has a recess 236 (similar to the rear connecting portion 12), and the front connecting portion 241 has a projecting block (similar to the front engaging portion 22) that matches the recess 236 and partially overlaps the rear engaging portion 231 in the direction parallel to the dorsoventral axis. In other embodiments, it may also be that the rear engaging portion 231 has a projecting block while the front connecting portion 241 has a recess. In this embodiment, the controller 6 is hermetically sealed within the front body 1. In other embodiments, the controller 6 may be hermetically sealed within the rear body 2, in the first segment 23, for example (not shown).

The recess 236 is receding in the swimming direction, and the rear engaging portion 231 has a third projecting block 232 and a fourth projecting block 233. The fourth projecting block 233 is opposite to and spaced apart from the third projecting block 232 in the direction parallel to the dorsoventral axis of the robotic fish to define the recess 236 therebetween. The rear engaging portion 231 further has a fixed component 234 (e.g., a block) fixedly disposed in the third projecting block 232, and a bearing 235 embedded in the fourth projecting block 233.

The third driving unit 7 is disposed and hermetically sealed in the front connecting portion 241, and is configured to output kinetic energy to the rear engaging portion 231 at the overlapping portion between the front connecting portion 241 and the rear engaging portion 231 to drive the first segment 23 to swing left and right relative to the second segment 24. To be specific, the third driving unit 7 includes a motor 71 and a shaft 72. The motor 71 is fixedly disposed and hermetically sealed in the front connecting portion 241, and is electrically connected to the controller 6 via conducting wires in a manner similar to the electrical connection between the controller 6 and each of the first driving unit 3 and the second driving unit 5, and is configured to operate under control of the controller 6. The shaft 72 is coaxially connected to a rotor (not shown) of the motor 71, and extends from the front connecting portion 241 toward and into the rear engaging portion 231. More specifically, one end of the shaft 72 is fixedly connected to the fixed component 234 in the third projecting block 232, and the other end of the shaft 72 is coaxially connected to the rotor of the motor 71.

The front connecting portion 241 of the second segment 24 includes a forward projecting block 242 projecting toward the first segment 23 and extending into the recess 236 of the rear engaging portion 231, so that the front connecting portion 241 overlaps the rear connecting portion 231 in the direction parallel to the dorsoventral axis of the robotic fish. The forward projecting block 242 of the front connecting portion 241 has a bottom side 2421 facing the fourth projecting block 233, and the front connecting portion 241 further includes a supporting rod 243 that extends from the bottom side 2421 of the forward projecting block 242 along the direction parallel to the dorsoventral axis, and that extends into and is connected rotatably to the fourth projecting block 233. In this embodiment, one end of the supporting rod 243 that is disposed in the fourth projecting block 233 is connected to the bearing 235 in the fourth projecting block 233. Therefore, the supporting rod 243 of the front connecting portion 241 can support the second segment 24 to make the second segment 24 swing steadily from side to side relative to the first segment 23. As a result, when the kinetic energy generated by the motor 71 is outputted to the first segment 23 through the shaft 72, the first segment 23 can swing steadily from side to side relative to the second segment 24. In other embodiments, it may also be that the shaft 72 is fixedly connected to the fourth projecting block 233 of the rear engaging portion 231, while the supporting rod 243 of the front connecting portion 241 extends from a top outer surface of the forward projecting block 242 of the front connecting portion 241 that is opposite to the bottom side 2421 into the third projecting block 231 and is connected to a bearing disposed in the third projecting block 231.

Likewise, watertightness of a portion of the forward projecting block 242 of the front connecting portion 241 and a portion of the third projecting block 232 where the shaft 72 extends through, and watertightness of a portion of the fourth projecting block 233 where the supporting rod 243 extends through can be achieved by the same structural configuration as shown in FIG. 3. In this embodiment, each of the forward projecting block 242 and the third projecting block 232 is provided with a bearing and an oil seal, through which the shaft extends, so as to transmit the kinetic energy generated by the motor 71 to the first segment 23 and to prevent water from penetrating into the forward projecting block 242 and the third projecting block 232. The fourth projecting block 233 is also provided with a bearing and an oil seal, through which the supporting rod 243 extends, so as to prevent water from penetrating into the fourth projecting block 233. Alternatively, in some embodiments, a bearing, to which the supporting rod 243 is connected, may be fixed directly on a top outer surface of the fourth projecting block 243 that faces the bottom side 2421 of the forward projecting block 242.

Figure 7:
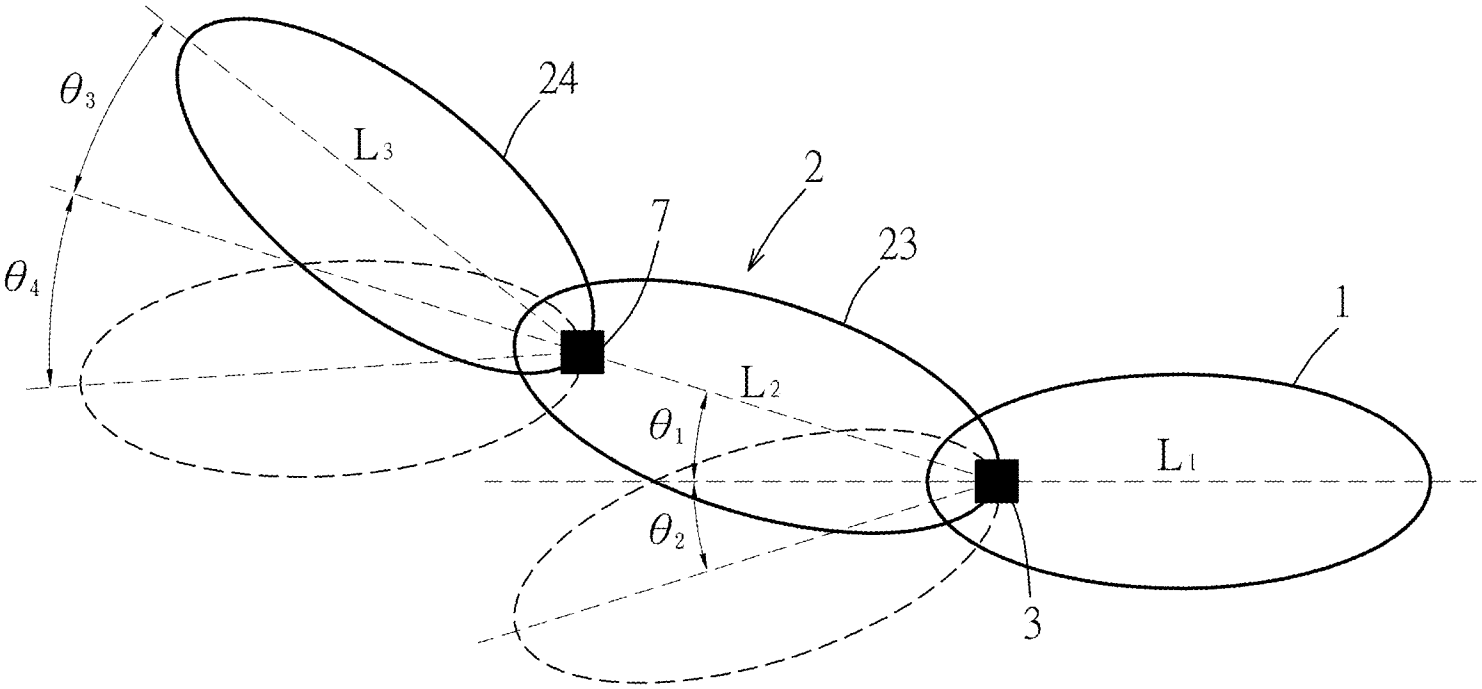
FIG. 7 is a schematic diagram illustrating a first segment and a second segment of the rear body swinging relative to the front body and the first segment, respectively.

Further referring to FIG. 7, when the first driving unit 3 is controlled by the controller 6, the controller 6 also controls the motor 71 of the third driving unit 7 to continuously rotate back and forth, and then the shaft 72 drives the first segment 23 to swing from side to side relative to the second segment 24 by a left swing angle ($\theta_3$) and a right swing angle ($\theta_4$). Specifically, the second imaginary central line ($L_2$) of the first segment 23 and a third imaginary central line ($L_3$) of the second segment 24 that extends in a longitudinal direction of the second segment 24 form the left swing angle ($\theta_3$) when the second segment 24 swings to the left relative to the first segment 23, and form the right swing angle ($\theta_4$) when the second segment 24 swings to the right relative to the first segment 23. Thus, when the robotic fish is placed in the water, the first segment 23 of the rear body 2 swings from side to side relative to the front body 1 by the left swing angle ($\theta_1$) and the right swing angle ($\theta_2$), and the first segment 23 and the second segment 24 of the rear body 2 also swing relative to each other by the left swing angle ($\theta_3$) and the right swing angle ($\theta_4$), generating a forward propelling force to move the robotic fish to swim forward.

Figure 8:
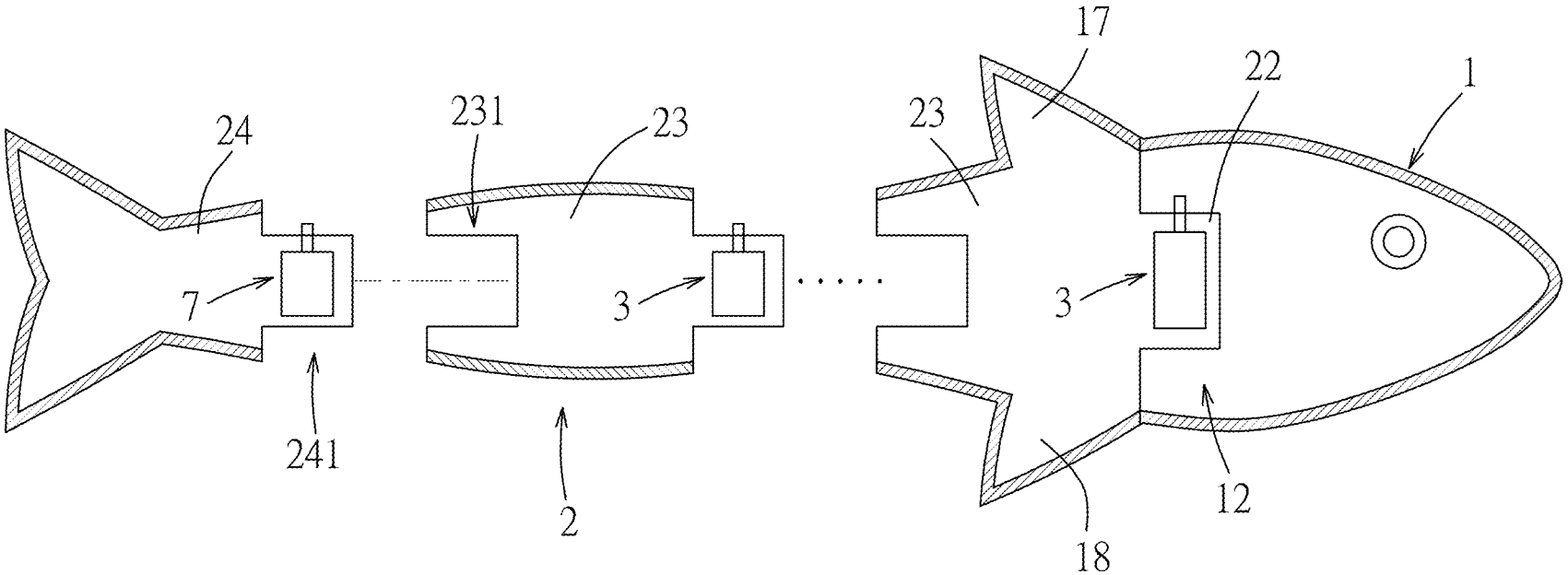
FIG. 8 is a schematic diagram illustrating another embodiment of the robotic fish according to the disclosure.

Referring to FIG. 8, each of the aforementioned first driving unit 3 and the third driving unit 7 may be considered as a joint of the robotic fish. In an embodiment of the robotic fish that is a long, flat or slender, multi-jointed (or eel-like) robotic fish, the rear body 2 of the robotic fish includes a plurality of the first segments 23 that are connected in series in the swimming direction between the front body 1 and the second segment 24, so that a body length of the robotic fish is expanded as compared to the previously discussed embodiments. In such embodiment, the front engaging portion 22 of a foremost one of the first segments 23 in the swimming direction is connected to the rear connecting portion 12 of the front body 1, and the rear engaging portion 231 of a last one of the first segments 23 in the swimming direction is connected to the front connecting portion 241 of the second segment 24. The robotic fish also includes a plurality of the first driving units 3 that correspond respectively to the first segments 23, one of the first driving units 3 that corresponds to the foremost one of the first segments 23 is configured to drive the front body 1 to swing, and each of other one(s) of the first driving units 3 is an intermediate driving unit 3 and is configured to drive one of the first segments 23 that is immediately in front of another one of the first segments 23 in which the intermediate driving unit 3 is disposed. The third driving unit 7 is configured to drive the last one of the first segments 23 to swing.

Figure 9:
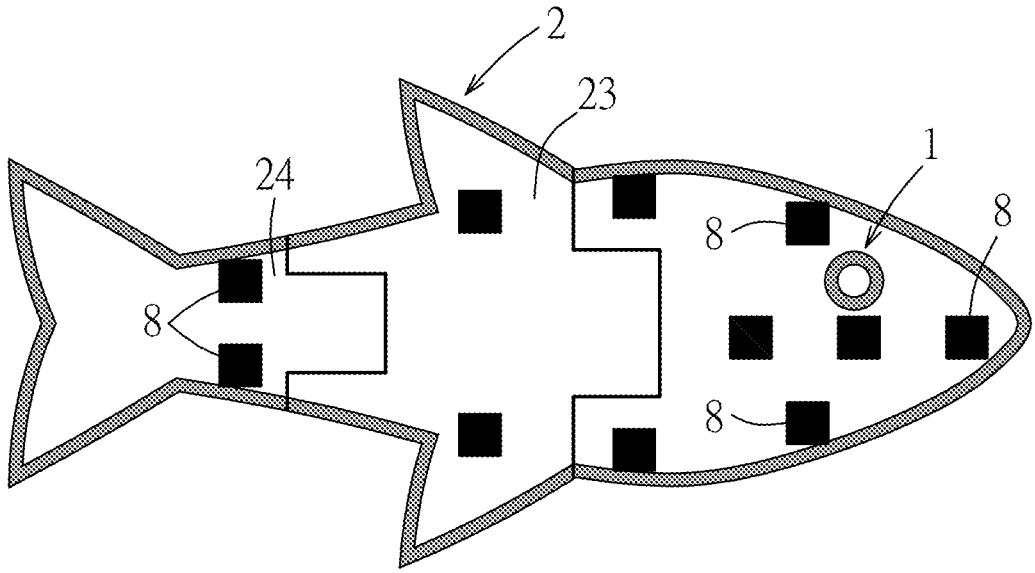
FIG. 9 is a schematic diagram illustrating distribution of multiple obstacle detectors dispersed over the front body and the rear body according to an embodiment of the disclosure.

Referring to FIG. 9, an embodiment of the robotic fish further includes a plurality of obstacle detectors 8 dispersed over the front body 1 and the rear body 2 (e.g., at front, upper, lower and side portions of the front body 1 and the upper, lower and sides of the first segment 23 and the second segment 24 of the rear body 2, etc.). The obstacle detectors 8 are electrically connected to the controller 6 (the electrical connection is not shown), and each of the obstacle detectors 8 is configured to detect presence of an obstacle and to transmit a detection signal indicating whether there is an obstacle to the controller 6. The controller 6 is configured to determine whether there is an obstacle near the robotic fish in a certain direction according to the detecting signals transmitted respectively from the obstacle detectors 8. When it is determined that there is an obstacle near the robotic fish, the controller 6 is further configured, according to the detecting signals, to estimate a distance from the obstacle based on detecting signals, and to control one or more of the following operations: operation of the first driving unit 3 driving the front body 1 to swing left and right with respect to the first segment 23; operation of the second driving unit 5 driving the weight 41 to move in one of the swimming direction and the posterior direction; and operation of the third driving unit 7 driving the first segment 24 to swing left and right relative to the first segment 23. As a result, the robotic fish can dodge to avoid the obstacle. For example, each of the obstacle detectors 8 may be, but is not limited to, an optical detector (e.g., an infrared detector), a sound wave detector (e.g., a sonar), etc.

In this embodiment, in addition to controlling the robotic fish to automatically dodge obstacles and to autonomously swim through auto-execution of a software program by a processor (not shown) of the controller 6, the controller 6 can also communicate with an external device (e.g., a remote control, a smart phone, etc.) to receive from the external device a control command indicating a swimming action and to control the operation of the first, second, and third driving units 3, 5, 7 in accordance with the control command to drive the robotic fish underwater to perform the swimming action, such as moving forward, turning left, turning right, ascending, or diving. For instance, by the controller 6 suitably controlling the first and third driving units 3, 7, various segments of the robotic fish (i.e., the front body 1, and the first and second segments 23, 24 of the rear body 2) connected by the first and third driving units 3, 7 can move in coordination with each other. For example, in response to the control command, for each of the motors 31, 71, the controller 6 will continuously calculate a rotation angle by which the motor 31, 71 needs to rotate according to the control command. Then, the controller 6 converts the rotation angle to a position command indicating a target angular position of the rotor, and transmits the position command to the motor 31, 71 through the corresponding conducting wire (e.g., control cable). Upon receiving the position command, the motor 31, 71 rotates the rotor to the angular position, so that the robotic fish can swim forward, turn left, turn right, etc., as indicated by the control command.

Figure 10:
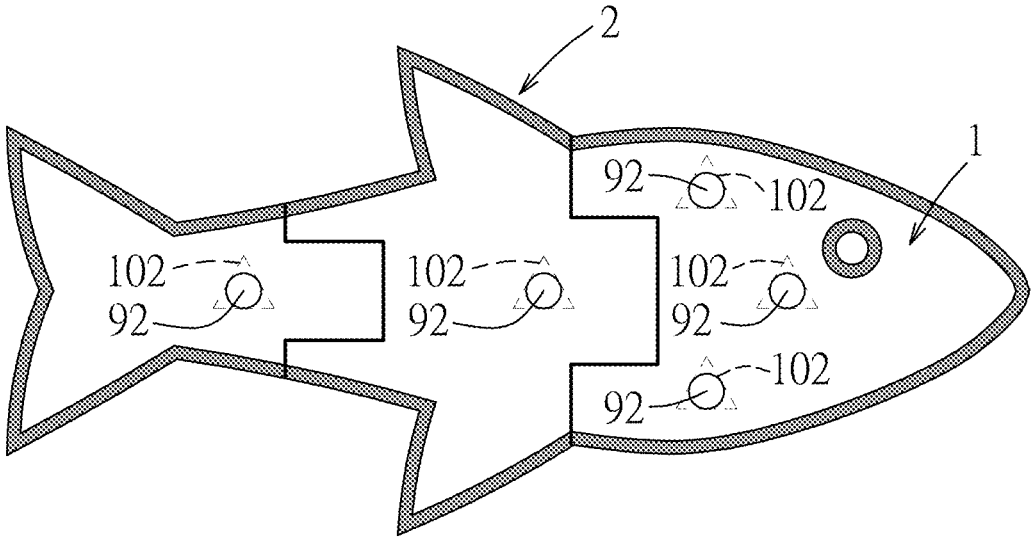
FIG. 10 is a schematic diagram illustrating distribution of multiple internal coils over the front body and the rear body according to an embodiment of the disclosure.
Figure 11:
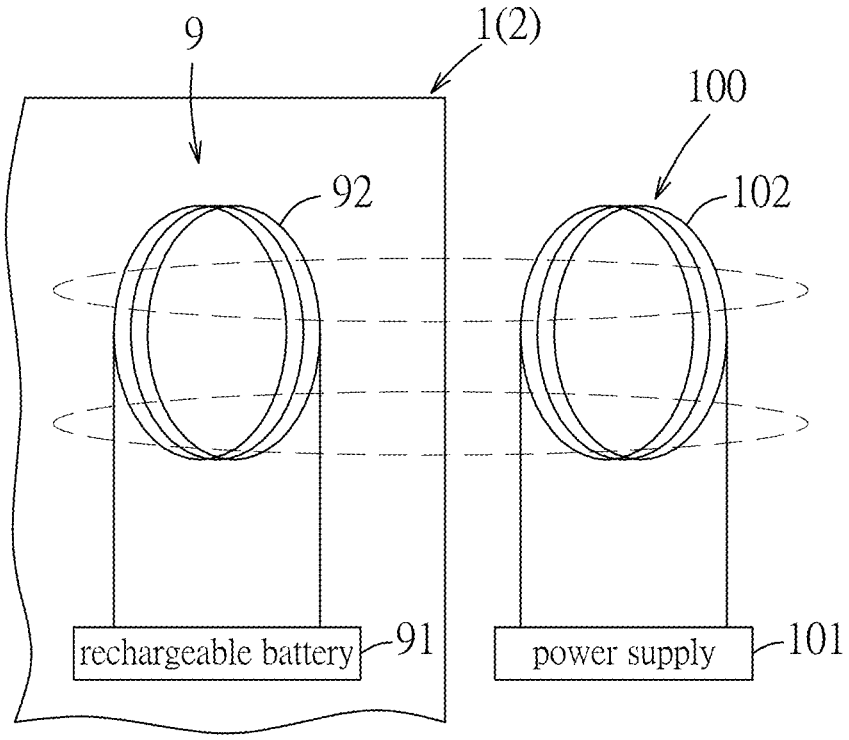
FIG. 11 is a schematic diagram illustrating a rechargeable power source of the robotic fish according to an embodiment of the disclosure.

Referring to FIGS. 10 and 11, according to some embodiments, the robotic fish further includes a rechargeable power source 9 that is disposed in the front body 1 and the rear body 2, and that can be recharged by an external wireless charging device 100 that is separated from the robotic fish. The wireless charging device 100 includes a power supply 101, and a plurality of external coils 102 electrically connected to the power supply 101. The rechargeable power source 9 includes a rechargeable battery 91 disposed within the front body 1 or the rear body 2 to provide electric power to the controller 6 and the obstacle detectors 8, and a plurality of internal coils 92 electrically connected to the rechargeable battery 91 and configured to generate electrical energy for charging the rechargeable battery 91 by virtue of electromagnetic induction with the external coils 102. A number of the external coils 102 and a number of the internal coils 92 are identical. In some embodiments, the rechargeable power source 9 may include only one internal coil 92, in which case the wireless charging device 100 includes only one external coil 102. Each of the internal coils 92 may be disposed at any position of the robotic fish where the internal coil 92 is easily aligned with and close to a respective one of the external coils 102 when the robotic fish is close to the wireless charging device 100. When the robotic fish is close to the wireless charging device 100, the internal coils 92 are aligned respectively with the external coils 102, the power supply 101 provides current to the external coils 102 to make each internal coil 92 generate electrical energy (current) by virtue of electromagnetic induction between the internal coil 92 and the respective one of the external coils 102, so as to charge the rechargeable battery 91.

In order to easily align the internal coils 92 respectively with the external coils 102, multiple magnets (not shown) can be fixedly disposed at respective positions respectively around the external coils 102 and the internal coils 92, so that when the internal coils 92 are close respectively to the external coils 102, the internal coils 92 can be automatically aligned with the external coils 102 by the magnetic force.

The above-mentioned configuration is used to charge the robotic fish outside an aquarium where the robotic fish is placed; that is to say, the robotic fish has to be removed from water before it is to be charged. In the case of charging the robotic fish in water, the external coils 102 and the magnets corresponding respectively to the external coils 102 are mounted on an inner or outer wall of the aquarium so that when the rechargeable battery 91 is running out of power, the controller 6 may control the driving units 3, 5, 7 to make the robotic fish swim slowly to a position where the external coils 102 are mounted. Subsequently, the internal coils 92 are aligned respectively with the external coils 102 by virtue of the magnets, and then the rechargeable battery 91 can be charged. When the charging process is completed, the controller 6 may control the driving units 3, 7 to make the front and rear bodies 1, 2 of the robotic fish swing so as to detach the robotic fish from the magnets on the wall of the aquarium and then continue to swim.

The controller 6 may include a processor (not shown), and a storage (not shown) storing a software program that may be read and executed by the processor to perform the operations described herein. The processor of the controller 6 may include, but not limited to, a single core processor, a multi-core processor, a dual-core mobile processor, a microprocessor, a microcontroller, a digital signal processor (DSP), afield-programmable gate array (FPGA), an application specific integrated circuit (ASIC), and/or a radio-frequency integrated circuit (RFIC), etc.

Figure 12:
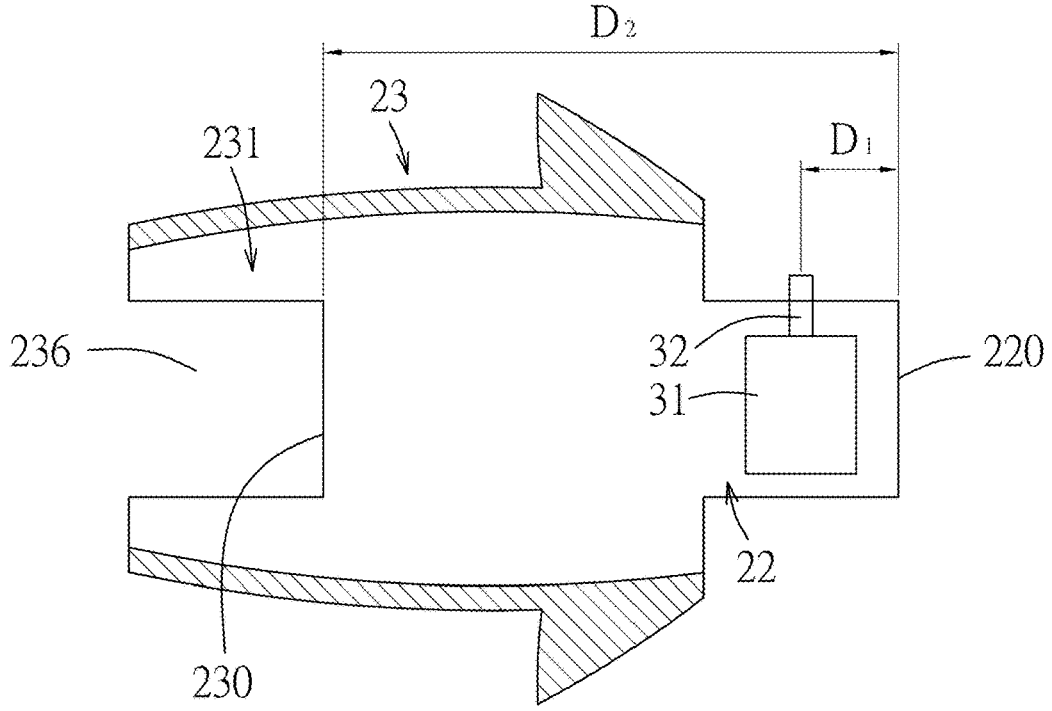
FIGS. 12 to 18 are schematic diagrams illustrating various dimensional ratios of the robotic fish according to some embodiments of this disclosure.

In order to swim more steadily, the torque outputted by the motors 31, 71 and applied to the front and rear bodies 1, 2 should be in an appropriate range. FIG. 12 illustrates various dimensions relative to the motor 31 and the first segment 23 of the rear body 2. The front engaging portion 22 has a foremost point 220 in the swimming direction, and a distance between the central axis of the shaft 32 and a first imaginary line parallel to the central axis of the shaft 32 and passing through the foremost point 220 of the front engaging portion 22 is referred to as a first distance ($D_1$). The recess 236 of the rear engaging portion 231 has an extreme point 230 closest to the front engaging portion 22 in the swimming direction, and a distance between the first imaginary line and a second imaginary line parallel to the central axis of the shaft 32 and passing through the extreme point 230 of the recess 236 of the rear engaging portion 231 is referred to as a second distance ($D_2$). According to some embodiments, a ratio of the first distance ($D_1$) to the second distance ($D_2$) ranges from 0.1 to 0.75. As long as the ratio is between 0.1 and 0.75 (i.e., $0.1 \leq D_1/D_2 \leq 0.75$), the torque generated by the motor 31 contributes to steady swimming of the robotic fish.

Figure 13:
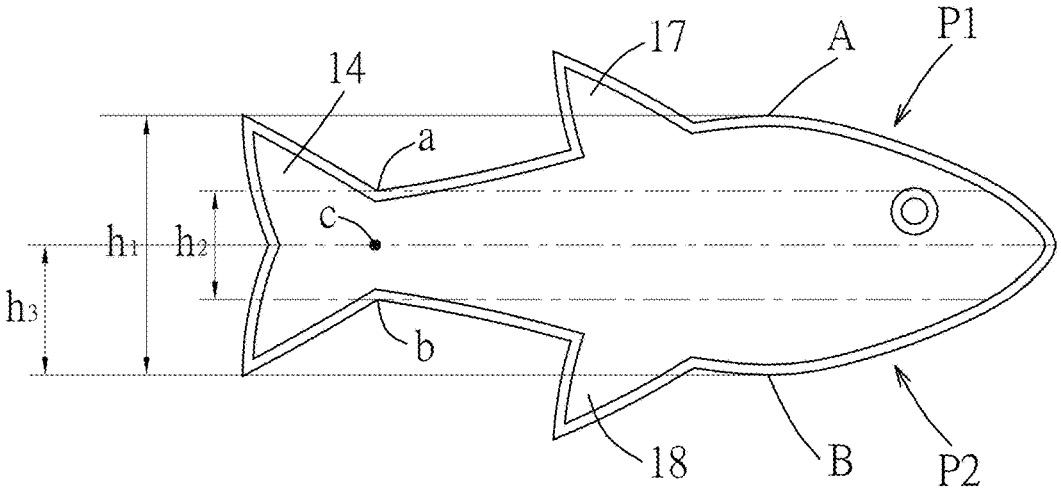

Referring to FIG. 13, in order to generate a stable propulsive force when the robotic fish is swinging the caudal fin 14, various ratios among dimensions of the robotic fish in a vertical direction parallel to the dorsoventral axis should be designed in appropriate ranges. The robotic fish has a frontal plane (F) (see FIG. 19) that divides the robotic fish into a dorsal part (P1) and a ventral part (P2). A point that is at the dorsal part (P1) and that is closest to the frontal plane (F) in the vertical direction in relation to other points at the dorsal part (P1) is defined as an upper valley point (a) of the robotic fish. A point that is at the ventral part (P2) and that is closest to the frontal plane (F) in the vertical direction in relation to other points at the ventral part (P2) is defined as a lower valley point (b) of the robotic fish. A point that is at the dorsal part (P1) and that is farthest from the frontal plane (F) in the vertical direction in relation to other points at the dorsal part (P1) is defined as a a top point (A) of the robotic fish. A point that is at the ventral part (P2) and that is farthest from the frontal plane (F) in the vertical direction in relation to their points at the ventral part (P2) is defined as a bottom point (B) of the robotic fish. According to some embodiments, a ratio of a third distance ($h_3$) between the bottom point (B) and a midline that passes through a middle point (c) equally distant from the upper valley point (a) and the lower valley point (b) in the vertical direction to a fourth distance ($h_1$) between the top point (A) and the bottom point (B) in the vertical direction ranges from 0.3 to 0.85, and a ratio of a fifth distance ($h_2$) between the upper valley point (a) and the lower valley point (b) in the vertical direction to the fourth distance ($h_1$) ranges from 0.2 to 0.75 (i.e., $0.3 \leq h_3/h_1 \leq 0.85$, $0.2 \leq h_2/h_1 \leq 0.75$).

In order to swim smoothly and steadily in the water, the robotic fish needs to be designed to have a proper streamline to decrease resistance to motion of the robotic fish swimming through water and for the robotic fish to swim without turbulence. If a width of a head of the robotic fish is too narrow, the robotic fish may be easily deflected by water flow. However, excessive resistance to water flow may result if the width of the head of the robot fish is too wide. Therefore, the head and the body of the robotic fish according to some embodiments are designed to have an appropriate streamline through an experimentation process, so that the robotic fish can generate stable and great propulsive force by the swinging of the caudal fin 14.

Figure 14:
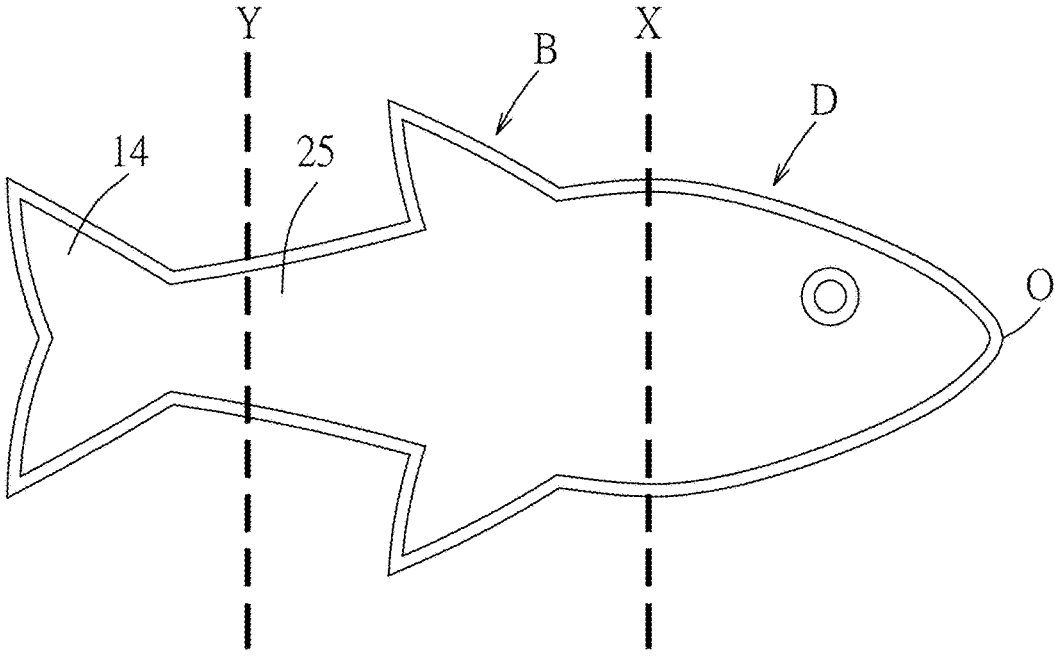
Figure 15:
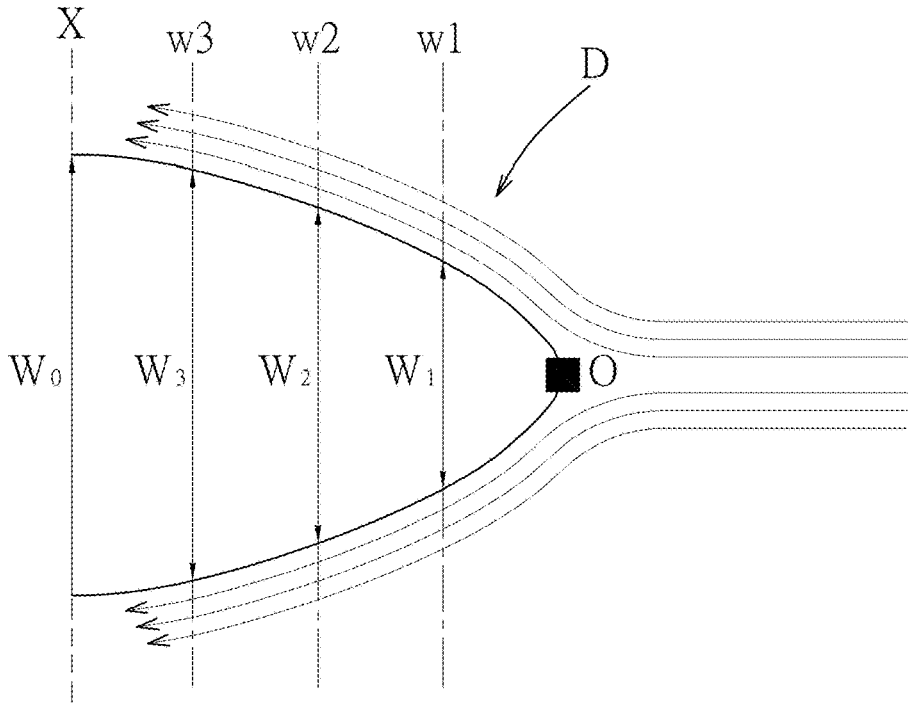
Figure 16:
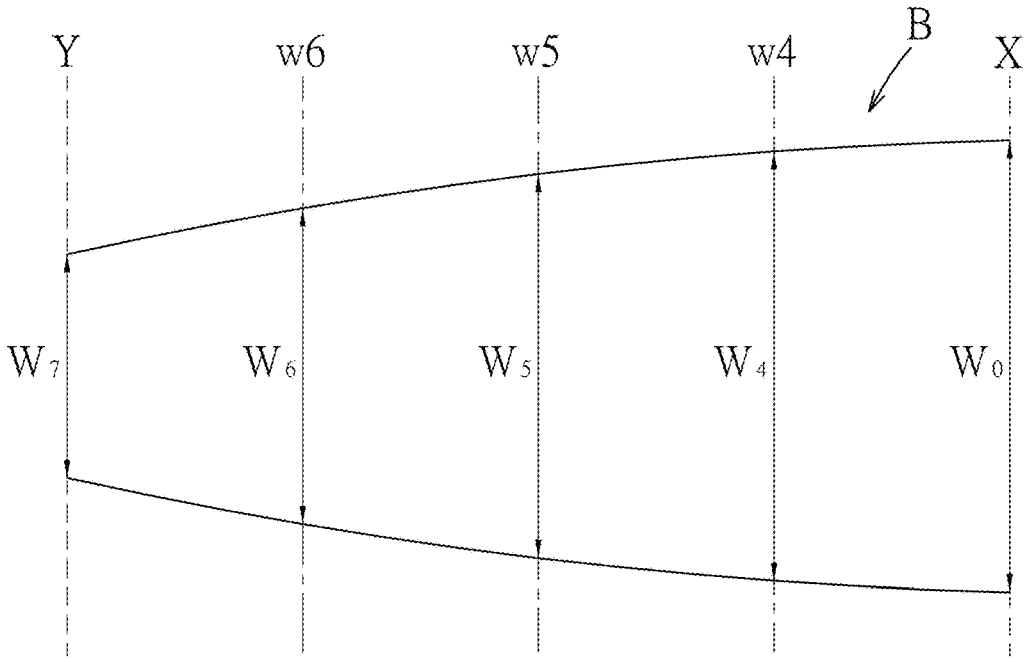

Referring to FIGS. 14 to 16, the robotic fish has a foremost point (O) in the swimming direction, a first body section (D) extending from the foremost point (O) to a first transverse plane (X) where the robotic fish has a greatest width ($W_0$), and a second body section (B) extending from the first transverse plane (X) to a second transverse plane (Y) where the caudal fin 14 is connected to the rear end 25 of the rear body 2 (e.g., the second segment 24 (see FIG. 6)).

The robotic fish further has first, second and third widths ($W_1$, $W_2$, $W_3$) respectively at one-fourth, two-fourths and three-fourths of a length of the first body section (D) from the foremost point (O). Specifically, the first body section (D) is divided into quarters in the swimming direction by three imaginary dividing lines (w1, w2, w3), and the first, second and third widths ($W_1$, $W_2$, $W_3$) are respectively at the imaginary dividing lines (w1, w2, w3). According to some embodiments, a ratio of the first width ($W_1$) to the greatest width ($W_0$) ranges from 0.4 to 0.9 ($0.4 \le W_1/W_0 \le 0.9$), a ratio of the second width ($W_2$) to the greatest width ($W_0$) ranges from 0.42 to 0.95 ($0.42 \le W_2/W_0 \le 0.95$), and a ratio of the third width ($W_3$) to the greatest width ($W_0$) ranges from 0.44 to 1 ($0.44 \le W_3/W_0 \le 1$). Further, the greatest width ($W_0$) is greater than or equal to the third width ($W_3$), the third width ($W_3$) is greater than the second width ($W_2$), and the second width ($W_2$) is greater than the first width ($W_1$) (i.e., $W_0 \ge W_3 > W_2 > W_1$).

The robotic fish further has fourth, fifth and sixth widths ($W_4$, $W_5$, $W_6$) respectively at one-fourth, two-fourths and three-fourths of a length of the second body section (B) from the first transverse plane (X), and a seventh width ($W_7$) at the second transverse plane (Y). Specifically, the second body section (B) is divided into quarters in the swimming direction by three imaginary dividing lines (w4, w5, w6), and the fourth, fifth and sixth widths ($W_4$, $W_5$, $W_6$) are respectively at the imaginary dividing lines (w4, w5, w6). According to some embodiments, a ratio of the fourth width ($W_4$) to the greatest width ($W_0$) ranges from 0.5 to 1 ($0.5 \le W_4/W_0 \le 1$), a ratio of the fifth width ($W_5$) to the greatest width ($W_0$) ranges from 0.45 to 0.96 ($0.45 \le W_5/W_0 \le 0.96$), a ratio of the sixth width ($W_6$) to the greatest width ($W_0$) ranges from 0.4 to 0.94 ($0.4 \le W_6/W_0 \le 0.94$), and a ratio of the seventh width ($W_7$) to the greatest width ($W_0$) ranges from 0.35 to 0.92 ($0.35 \le W_7/W_0 \le 0.92$). Furthermore, the greatest width ($W_0$) is greater than the fourth width ($W_4$), the fourth width ($W_4$) is greater than the fifth width ($W_5$), the fifth width ($W_5$) is greater than the sixth width ($W_6$), and the sixth width ($W_6$) is greater than the seventh width ($W_7$) (i.e., $W_0 \ge W_4 > W_5 > W_6 > W_7$).

Figure 17:
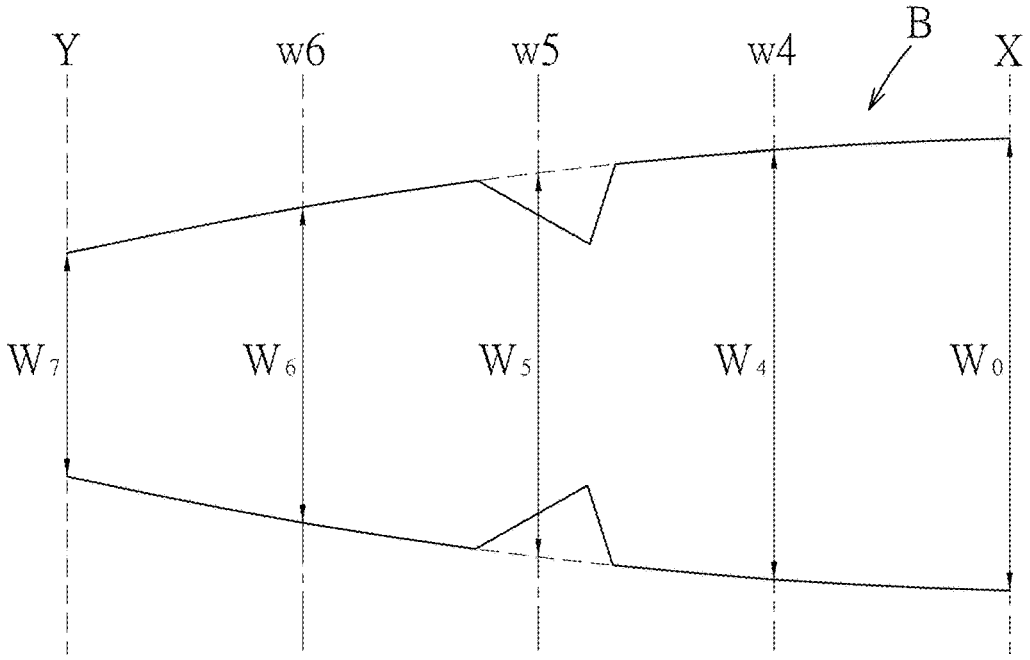

It is worth mentioning that, if the contour of the second body section (B) has a cut, a notch or a recess, for the purpose of calculating the ratio of each width ($W_4$, $W_5$, $W_6$, $W_7$) to the greatest width ($W_0$), the widths ($W_4$, $W_5$, $W_6$, $W_7$) should be measured with respect to an overall streamlined curve of the second body section (B) with the cut, notch or recess being filled, and not real widths of the second body section (B). For example, the second body section (B) shown in FIG. 17 has notches at the imaginary dividing line (w5), and the fifth width ($W_5$) of the second body section (B) should be measured between two dashed lines that indicate a streamlined curve of the second body section (B) with the notches being filled, rather than between two solid lines that indicate a real contour of the second body section (B).

Figure 18:
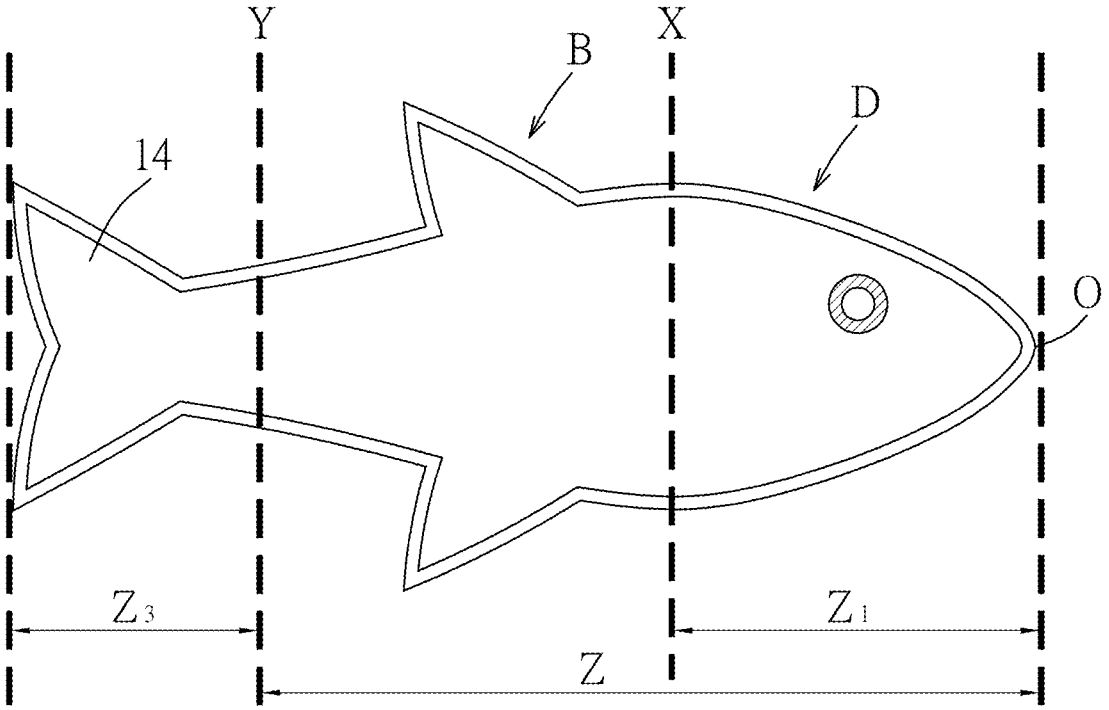

Referring to FIG. 18, according to some embodiments, a ratio of a length ($Z_1$) of the first body section (D) to a total length (Z) of the first and second body sections (D, B) ranges from 0.1 to 0.75 ($0.1 \le Z_1/Z \le 0.75$), and a ratio of a length ($Z_3$) of the caudal fin 14 to an overall length (Z+Z3) of the robotic fish ranges from 0.05 to 0.5 ($0.05 \le Z_3/(Z+Z3) \le 0.5$).

Figure 19:
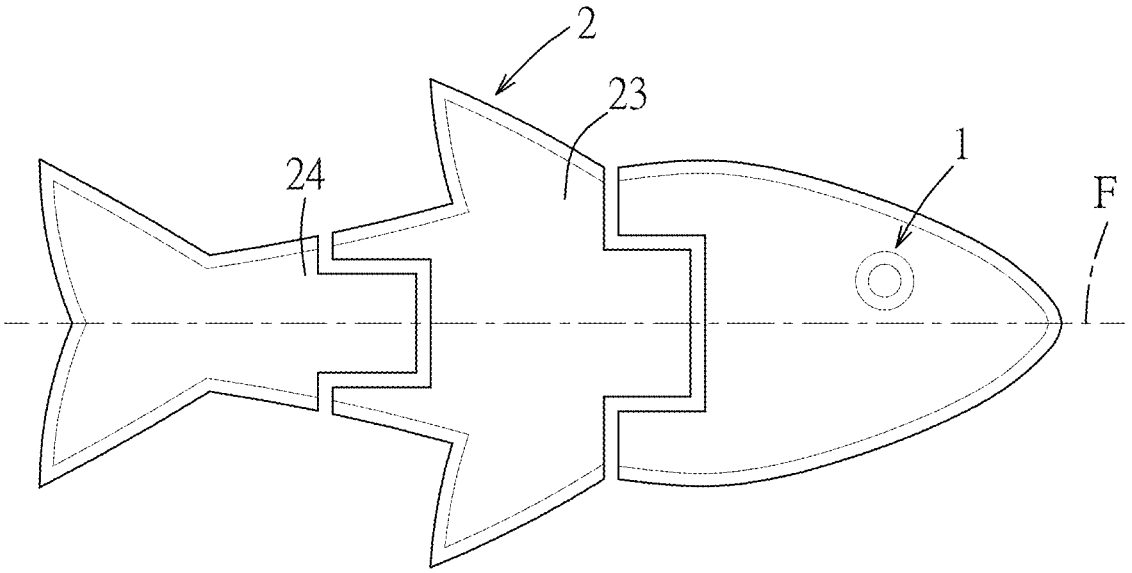
FIG. 19 is a schematic side view of the robotic fish.

Referring to FIGS. 6 and 19, in order to enable the segments (i.e., the front body 1, the first segment 23 and the second segment 24) connected by the driving units 3 and 7 to rotate smoothly without interfering with each other, there is a gap between every adjacent two of these segments to avoid collision between the adjacent two segments when the two segments rotate relative to each other. In addition, the adjacent two segments of the robotic fish respectively have two sides that face each other and that have non-interfering contours (e.g., a concave curved line, a convex curved line or a chamfer) to further avoid interference therebetween.

Figure 20:
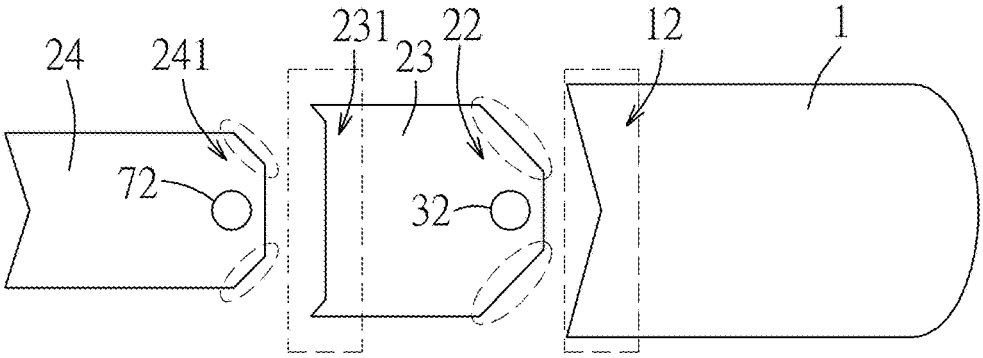
FIG. 20 is a schematic sectional view of the robotic fish on a frontal plane according to an embodiment of this disclosure.

FIG. 20 is a cross-sectional view taken along an imaginary line A-A in FIG. 19 to illustrate a cross-sectional configuration that is designed to prevent the front body 1, the first segment 23 and the second segment 24 from interfering with each other according to an embodiment of this disclosure. In this embodiment, a cross section of the rear connecting portion 12 on the frontal plane (F) between the projecting blocks 121, 122 (see FIG. 6) has a first rear side that faces the front engaging portion 22. The first rear side of the rear connecting portion 12 has two line segments that interconnect substantially at a center of the first rear side to form a single angle (indicated by a dashed-line box) substantially pointing in the swimming direction. A cross section of the front engaging portion 22 on the frontal plane (F) has a first front side that faces the rear connecting portion 12. The first front side of the front engaging portion 22 has two lateral chamfers (each indicated by a dashed-line ellipse) that do not interfere with the rear connecting portion 12. Across section of the rear engaging portion 231 on the frontal plane (F) has a second rear side that faces the front connecting portion 241. The second rear side of the rear engaging portion 231 is a simple polygonal chain (indicated by a dashed-line box) that has two angles substantially pointing in the posterior direction and being laterally spaced apart from each other. A cross section of the front connecting portion 241 on the frontal plane (F) has a second front side that faces the rear engaging portion 231. The second front side of the front connecting portion 241 has two lateral chamfers (each indicated by a dashed-line ellipse) that do not interfere with the rear engaging portion 231.

Figure 21:
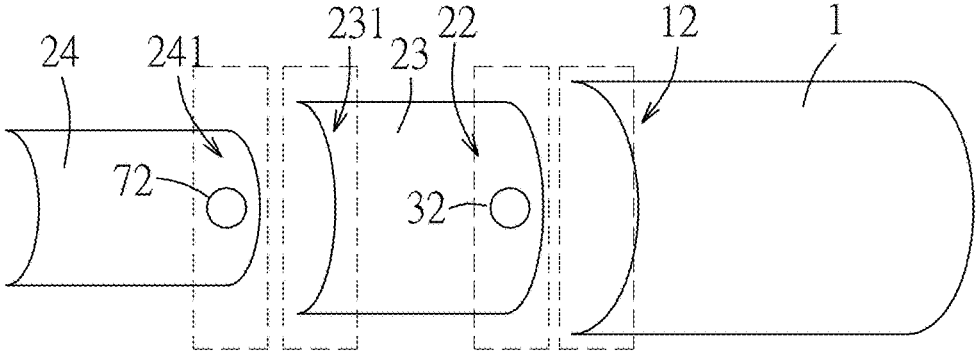
FIG. 21 is another schematic sectional view of the robotic fish on the frontal plane according to another embodiment of this disclosure.

FIG. 21 illustrates another embodiment of the cross-sectional configuration. In this embodiment, the first rear side of the rear connecting portion 12 is a concave curved line (indicated by a dashed-line box), and the first front side of the front engaging portion 22 is a convex curved line (indicated by a dashed-line box) that does not interfere with the rear connecting portion 12. The second rear side of the rear engaging portion 231 is a concave curved line (indicated by a dashed-line box), and the second front side of the front connecting portion 241 is a convex curved line (indicated by a dashed-line box) that does not interfere with the rear engaging portion 231.

Figure 22:
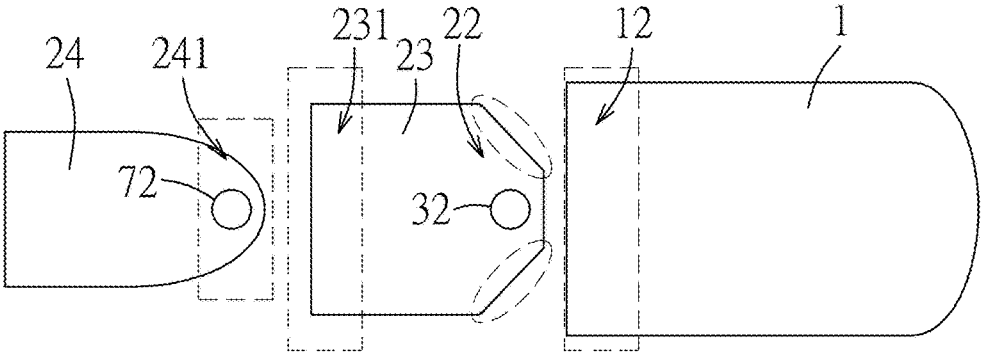
FIG. 22 is another schematic sectional view of the robotic fish on the frontal plane according to another embodiment of this disclosure.

FIG. 22 illustrates yet another embodiment of the cross-sectional configuration. In this embodiment, the first rear side of the rear connecting portion 12 is a straight line (indicated by a dashed-line box), and the first front side of the front engaging portion 22 has two lateral chamfers (each indicated by a dashed-line ellipse) that do not interfere with the rear connecting portion 12. The second rear side of the rear engaging portion 231 is a straight line (indicated by a dashed-line box), and the second front side of the front connecting portion 241 is a convex curved line (indicated by a dashed-line box) that does not interfere with the rear engaging portion 231. In some embodiments, the first front side of the front engaging portion 22 may be a convex curved line. In some embodiments, the second front side of the front connecting portion 241 may have two lateral chamfers.

Figure 23:
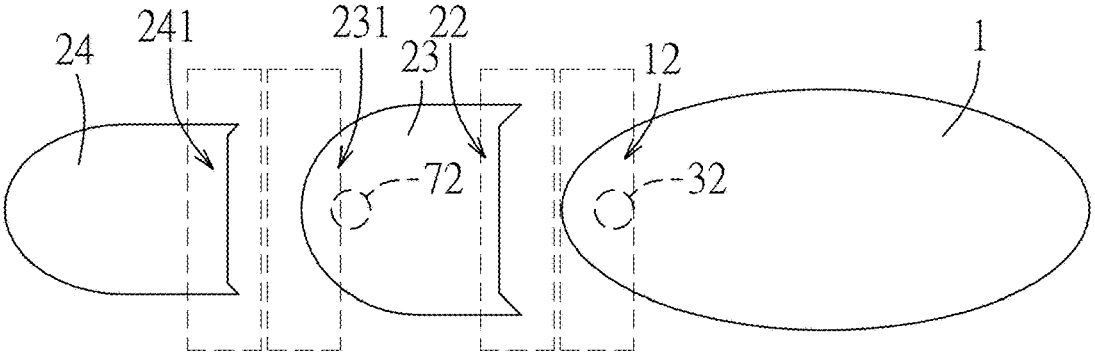
FIGS. 23 to 25 are top schematic views or bottom schematic views of the robotic fish according to different embodiments of this disclosure, respectively.

FIG. 23 is atop view or a bottom view of the robotic fish, illustrating an outline configuration that is designed to prevent the front body 1, the first segment 23 and the second segment 24 from interfering with each other according to an embodiment of this disclosure. The rear connecting portion 12 further has a first rear edge facing the front engaging portion 22, and the front engaging portion 22 further has a first front edge facing the rear connecting portion 12. In the top view (or bottom view) from a dorsal side (or ventral side) of the robotic fish, the first rear edge of the rear connecting portion 12 is a convex curved line (indicated by a dashed-line box), and the first front edge of the front engaging portion 22 has a simple polygonal chain (indicated by a dashed-line box) that does not interfere with the rear connecting portion 12. Specifically, the simple polygonal chain of the first front edge of the front engaging portion 22 has two angles substantially pointing in the swimming direction and being laterally spaced apart from each other. The rear engaging portion 231 further has a second rear edge facing the front connecting portion 241, and the front connecting portion 241 further has a second front edge facing the rear engaging portion 231. Similarly, in the top view (or bottom view) from the dorsal side (or ventral side) of the robotic fish, the second rear edge of the rear engaging portion 231 is a convex curved line (indicated by a dashed-line box), and the second front edge of the front connecting portion 241 has a simple polygonal chain (indicated by a dashed-line box) that does not interfere with the rear engaging portion 231. The simple polygonal chain of the second front edge of the front connecting portion 241 also has two angles substantially pointing in the swimming direction and being laterally spaced apart from each other.

Figure 24:
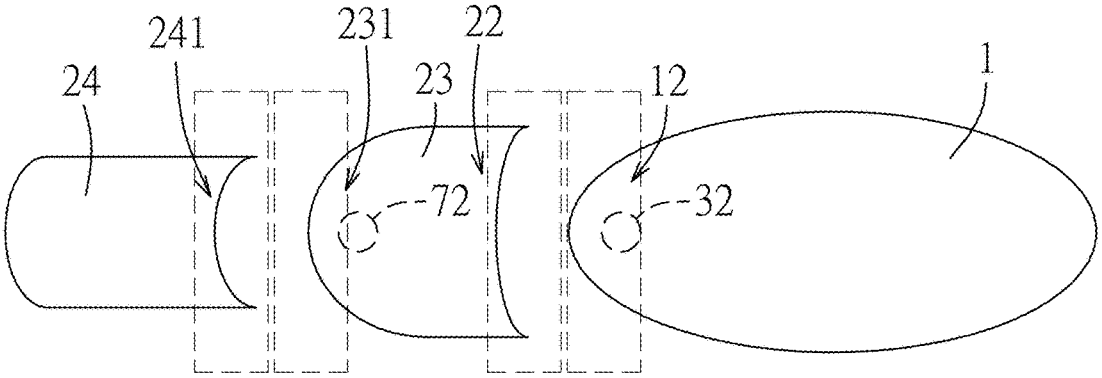

FIG. 24 illustrates another embodiment of the outline configuration. In this embodiment, the first rear edge of the rear connecting portion 12 is also a convex curved line (indicated by a dashed-line box), and the first front edge of the front engaging portion 22 is a concave curved line (indicated by a dashed-line box) that does not interfere with the rear connecting portion 12. The second rear edge of the rear engaging portion 231 is also a convex curved line (indicated by a dashed-line box), and the second front edge of the front connecting portion 241 is a concave curved line (indicated by a dashed-line box) that does not interfere with the rear engaging portion 231.

Figure 25:
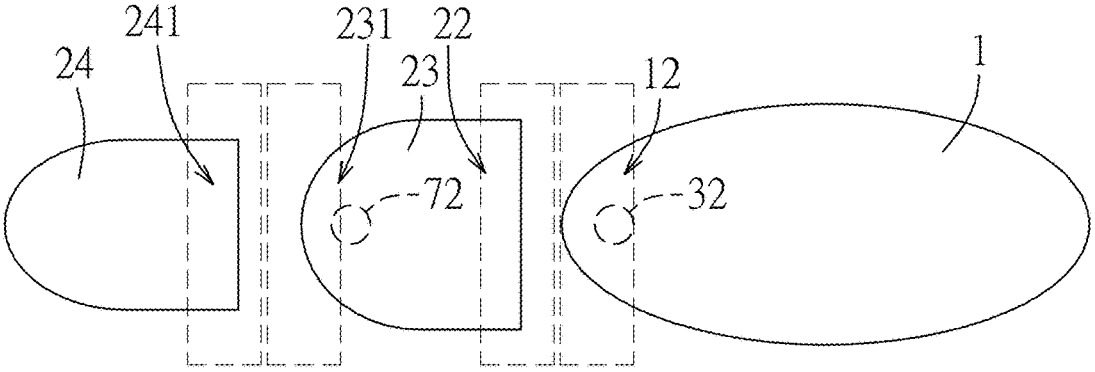

FIG. 25 illustrates yet another embodiment of the outline configuration. In this embodiment, the first rear edge of the rear connecting portion 12 is also a convex curved line (indicated by a dashed-line box), and the first front edge of the front engaging portion 22 is a straight line (indicated by a dashed-line box) that does not interfere with the rear connecting portion 12. The second rear edge of the rear engaging portion 231 is also a convex curved line (indicated by a dashed-line box), and the second front edge of the front connecting portion 241 is a straight line (indicated by a dashed-line box) that does not interfere with the rear engaging portion 231.

It should be noted that the first rear edge of the rear connecting portion 12 and the second rear edge of the rear engaging portion 231 may not necessarily both be convex curved lines, and may be one having a convex curved line and the other having two chamfers in other embodiments. Similarly, the configurations of the second rear edge of the rear engaging portion 231 and the second front edge of the front connecting portion 241 are not limited to this disclosure. In other embodiments, the second rear edge of the rear engaging portion 231 and the second front edge of the front connecting portion 241 may be one having two chamfers and the other having a convex curved line or a straight line, or may be one having a convex curved line and the other having a straight line or two chamfers. The outline configuration of the robotic fish is not limited to the embodiments shown in FIGS. 23 to 25, and may have other modifications as long as the rear connecting portion 12 and the front engaging portion 22 do not interfere with each other and the rear engaging portion 231 and the front connecting portion 241 do not interfere with each other when the first and second segments 23, 24 rotate relative to the front body 1 and the first segment 23, respectively.

In summary, the robotic fish includes the front body 1 and the rear body 2 that are pivotally connected to each other by the first driving unit 3, and the rear body 2 includes the first and second segments 23, 24 that are pivotally connected to each other by the third driving unit 7. By virtue of the first driving unit 3 driving the front body 1 to swing left and right relative to the rear body 2 and the third driving unit 7 driving the first segment 23 to swing left and right relative to the second segment 24, the robotic fish can swim forward. The second driving unit 5 adjusts the position of the weight 41 of the CG adjusting unit 4 to change the center of gravity of the robotic fish, so that the robotic fish can ascend or dive. Besides, by properly designing various dimensions of each segment of the robotic fish and various ratios among the dimensions of the segments, the robotic fish may swim relatively steadily and the propulsive force for driving the robotic fish to swim may be relatively stable.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A robotic fish comprising:

a front body having a rear connecting portion;

a rear body disposed behind said front body in a swimming direction, in which said robotic fish swims, and including a first segment having a front engaging portion that projects toward said front body in the swimming direction, that is connected to said rear connecting portion, that overlaps said rear connecting portion along a dorsoventral axis of said robotic fish, and that has a foremost point in the swimming direction, and a rear engaging portion that is opposite to said front engaging portion in the swimming direction, and that is formed with a recess receding toward said front body in the swimming direction and having an extreme point closest to said front engaging portion in the swimming direction, and a second segment having a front connecting portion that is connected to said rear engaging portion and that overlaps said rear engaging portion in a direction parallel to the dorsoventral axis, and a rear end opposite to said front connecting portion in the swimming direction, a caudal fin connected to said rear end of said second segment;

a first driving unit configured to drive said front body to swing left and right relative to said first segment, and including a motor that is disposed in said front engaging portion, and a shaft, said shaft having a central axis that extends along the dorsoventral axis, a first end that is connected to said motor, and a second end that is fixedly connected to said rear connecting portion;

a center-of-gravity (CG) adjusting unit disposed in said front body, and including a weight that is movable in one of the swimming direction and a posterior direction opposite to the swimming direction to adjust a center of gravity of said robotic fish;

a second driving unit disposed in said front body, connected to said CG adjusting unit, and configured to drive said weight to move in one of the swimming direction and the posterior direction;

a third driving unit disposed in said front connecting portion of said second segment, and configured to drive said first segment to swing left and right relative to said second segment; and a controller disposed in one of said front body and said rear body, electrically connected to said first, second and third driving units, and configured to control operation of said first, second and third driving units, wherein a ratio of a first distance between the central axis of said shaft and a first imaginary line parallel to the central axis of said shaft and passing through said foremost point of said front engaging portion to a second distance between the first imaginary line and a second imaginary line parallel to the central axis of said shaft and passing through said extreme point of said recess of said rear engaging portion ranges from 0.1 to 0.75.

2. The robotic fish of claim 1, wherein said rear connecting portion of said front body is formed with a recess receding in the swimming direction, and has two projecting blocks that are opposite to and spaced apart from each other along the dorsoventral axis to define said recess of said rear connecting portion, wherein said second end of said shaft is fixedly connected to one of said projecting blocks, and said front engaging portion includes a supporting rod extending along the dorsoventral axis and being connected rotatably to the other one of said projecting blocks.

3. The robotic fish of claim 2, wherein:

a cross section of said rear connecting portion on a frontal plane between said projecting blocks has a first rear side facing said front engaging portion and having two line segments that interconnect substantially at a center of said first rear side to form a single angle pointing in the swimming direction;

a cross section of said front engaging portion on the frontal plane has a first front side facing said rear connecting portion and having two lateral chamfers that do not interfere with said rear connecting portion;

a cross section of said rear engaging portion on the frontal plane has a second rear side facing said front connecting portion and being a simple polygonal chain that has two angles substantially pointing in the posterior direction and being laterally spaced apart from each other;

a cross section on the frontal plane of said front connecting portion has a second front side facing said rear engaging portion and having two lateral chamfers that do not interfere with said rear engaging portion;

said rear connecting portion further has a first rear edge in a top view of said robotic fish, and the first rear edge faces said front engaging portion and is a convex curved line;

said front engaging portion further has a first front edge in the top view of said robotic fish, and the first front edge faces and does not interfere with said rear connecting portion and is one of a straight line, a concave curved line, and a simple polygonal chain that has two angles substantially pointing in the swimming direction and being laterally spaced apart from each other;

said rear engaging portion further has a second rear edge in the top view of said robotic fish, and the second rear edge faces said front connecting portion and is a convex curved line; and said front connecting portion further has a second front edge in the top view of said robotic fish, and the second front edge faces and does not interfere with said rear engaging portion and is one of a concave curved line, a straight line, and a simple polygonal chain that has two angles substantially pointing in the swimming direction and being laterally spaced apart from each other.

4. The robotic fish of claim 2, wherein:

a cross section of said said rear connecting portion on a frontal plane between said projecting blocks has a first rear side facing said front engaging portion and being a concave curved line;

a cross section of said front engaging portion on the frontal plane has a first front side facing said rear connecting portion and being a convex curved line that does not interfere with said rear connecting portion;

a cross section of said rear engaging portion on the frontal plane has a second rear side facing said front connecting portion and being a concave curved line;

a cross section of said front connecting portion on the frontal plane has a second front side facing said rear engaging portion and being a convex curved line that does not interfere with said rear engaging portion;

said rear connecting portion further has a first rear edge in a top view of said robotic fish, and the first rear edge faces said front engaging portion and is a convex curved line;

said front engaging portion further has a first front edge in the top view of said robotic fish, and the first front edge faces and does not interfere with said rear connecting portion and is one of a straight line, a concave curved line, and a simple polygonal chain that has two angles substantially pointing in the swimming direction;

said rear engaging portion further has a second rear edge in the top view of said robotic fish, and the second rear edge faces said front connecting portion and is a convex curved line; and said front connecting portion further has a second front edge in the top view of said robotic fish, and the second front edge faces and does not interfere with said rear engaging portion and is one of a concave curved line, a straight line, and a simple polygonal chain that has two angles substantially pointing in the swimming direction and being laterally spaced apart from each other.

5. The robotic fish of claim 2, wherein:

a cross section of said rear connecting portion on a frontal plane between said projecting blocks has a first rear side facing said front engaging portion and being a straight line;

a cross section of said front engaging portion on the frontal plane has a first front side facing said rear connecting portion and having two lateral chamfers that do not interfere with said rear connecting portion;

a cross section of said rear engaging portion on the frontal plane has a second rear side facing said front connecting portion and being a straight line;

a cross section of said front connecting portion on the frontal plane has a second front side facing said rear engaging portion and being a convex curved line that does not interfere with said rear engaging portion;

said rear connecting portion further has a first rear edge in a top view of said robotic fish, and the first rear edge faces said front engaging portion and is a convex curved line;

said front engaging portion further has a first front edge in the top view of said robotic fish, and the first front edge faces and does not interfere with said rear connecting portion and is one of a straight line, a concave curved line, and a simple polygonal chain that has two angles substantially pointing in the swimming direction and being laterally spaced apart from each other;

said rear engaging portion further has a second rear edge in the top view of said robotic fish, and the second rear edge faces said front connecting portion and is a convex curved line; and said front connecting portion further has a second front edge in the top view of said robotic fish, and the second front edge faces and does not interfere with said rear engaging portion and is one of a concave curved line, a straight line, and a simple polygonal chain that has two angles substantially pointing in the swimming direction and being laterally spaced apart from each other.

6. The robotic fish of claim 1, wherein said CG adjusting unit further includes a driving component that is configured to be driven by said second driving unit to move said weight in one of the swimming direction and the posterior direction.

7. The robotic fish of claim 1, further comprising a plurality of obstacle detectors dispersed over said front body and said rear body, electrically connected to said controller, and each configured to detect presence of an obstacle and to transmit a detection signal indicating whether there is an obstacle to said controller, wherein said controller is configured to, according to the detection signals respectively transmitted from said obstacle detectors, control at least one of the following operations: operation of said first driving unit driving said front body to swing left and right with respect to said first segment; operation of said second driving unit driving said weight to move in one of the swimming direction and the posterior direction; and operation of said third driving unit driving said first segment to swing left and right with respect to said first segment.

8. The robotic fish of claim 1, further comprising a rechargeable power source that includes a rechargeable battery disposed in one of said front body and said rear body, and a coil electrically connected to said rechargeable battery and configured to generate electrical energy for charging said rechargeable battery by virtue of electromagnetic induction.

9. The robotic fish of claim 1, further comprising:

a dorsal fin and an anal fin that are connected to said rear body and that are made of a flexible material;

a pair of pectoral fins and a pair of pelvic fins that are connected to said front body and that are made of a flexible material; and a skin that is made of an elastic material, that has a decorative pattern and that covers said front body and said rear body.

10. The robotic fish of claim 1, wherein said rear body includes a plurality of said first segments that are connected in series in the swimming direction, said front engaging portion of a foremost one of said first segments in the swimming direction is connected to said rear connecting portion of said front body, and said rear engaging portion of a last one of said first segments in the swimming direction is connected to said front connecting portion of said second segment, wherein said robotic fish comprises a plurality of said first driving units that correspond respectively to said first segments, one of said first driving units that corresponds to said foremost one of said first segments is configured to drive said front body to swing, and each of other one(s) of said first driving units is an intermediate driving unit and is configured to drive one of said first segments that is immediately in front of another one of said first segments in which said intermediate driving unit is disposed, wherein said third driving unit is configured to drive said last one of said first segments to swing.

11. The robotic fish of claim 1, wherein said robotic fish has a frontal plane that divides said robotic fish into a dorsal part and a ventral part, said dorsal part having an upper valley point that is closest to the frontal plane in a vertical direction parallel to the dorsoventral axis and a top point that is farthest from the frontal plane in the vertical direction, said ventral part having a lower valley point that is closest to the frontal plane in the vertical direction and a bottom point that is farthest from the frontal plane in the vertical direction, wherein a ratio of a third distance between said bottom point and a midline that passes through a middle point equally distant from said upper valley point and said lower valley point in the vertical direction to a fourth distance between said top point and said bottom point in the vertical direction ranges from 0.3 to 0.85, and a ratio of a fifth distance between said upper point and said lower point in the vertical direction to the fourth distance ranges from 0.2 to 0.75.

12. The robotic fish of claim 1, wherein said robotic fish has a foremost point in the swimming direction, a first body section extending from the foremost point to a first transverse plane where said robotic fish has a greatest width, said robotic fish further having first, second and third widths respectively at one-fourth, two-fourths and three-fourths of a length of the first body section from the foremost point, wherein a ratio of the first width to the greatest width ranges from 0.4 to 0.9, a ratio of the second width to the greatest width ranges from 0.42 to 0.95, a ratio of the third width to the greatest width ranges from 0.44 to 1, the greatest width is greater than or equal to the third width, the third width is greater than the second width, and the second width is greater than the first width.

13. The robotic fish of claim 12, wherein said robotic fish further has a second body section extending from the first transverse plane to a second transverse plane where said caudal fin is connected to said rear end of said second segment of said rear body, said robotic fish further having fourth, fifth and sixth widths respectively at one-fourth, two-fourths and three-fourths of a length of the second body section from the first transverse plane, and a seventh width at the second transverse plane, wherein a ratio of the fourth width to the greatest width ranges from 0.5 to 0.98, a ratio of the fifth width to the greatest width ranges from 0.45 to 0.96, a ratio of the sixth width to the greatest width ranges from 0.4 to 0.94, a ratio of the seventh width to the greatest width ranges from 0.35 to 0.92, the greatest width is greater than or equal to the fourth width, the fourth width is greater than the fifth width, the fifth width is greater than the sixth width, and the sixth width is greater than the seventh width.

14. The robotic fish of claim 1, wherein said robotic fish has a foremost point in the swimming direction, a first body section extending from the foremost point to a first transverse plane where said robotic fish has a greatest width, a second body section extending from the first transverse plane to a second transverse plane where said caudal fin is connected to said rear end of said second segment of said rear body, wherein a ratio of a length of the first body section to a total length of the first and second body sections ranges from 0.1 to 0.75, and a ratio of a length of the caudal fin to an overall length of the robotic fish ranges from 0.05 to 0.5.

* * * * *